US006725794B2

(12) United States Patent
Usa

(10) Patent No.: US 6,725,794 B2
(45) Date of Patent: Apr. 27, 2004

(54) SEWING MACHINE WITH IMPROVED THREAD CUTTING MECHANISM

(75) Inventor: Shuichiro Usa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/385,642

(22) Filed: Mar. 12, 2003

(65) Prior Publication Data

US 2003/0183146 A1 Oct. 2, 2003

(30) Foreign Application Priority Data

Mar. 28, 2002 (JP) ..... 2002-091557

(51) Int. Cl.[7] ..... D05B 65/00
(52) U.S. Cl. ..... 112/292
(58) Field of Search ..... 112/285, 291, 112/292, 293, 295, 296, 298, 300, 301

(56) References Cited

U.S. PATENT DOCUMENTS 2,826,160 A * 3/1958 Adams ..... 112/289
4,200,050 A 4/1980 Bianchi
4,455,957 A 6/1984 Vollmar
5,370,073 A * 12/1994 Hayashi ..... 112/291
5,647,290 A * 7/1997 Kastrup et al. ..... 112/66
5,775,246 A * 7/1998 Wen ..... 112/292
5,937,776 A * 8/1999 Ogawa et al. ..... 112/292

FOREIGN PATENT DOCUMENTS

JP A 7-68073 3/1995
JP B2 2871201 1/1999
JP A 11-192393 7/1999

* cited by examiner

*Primary Examiner*—Ismael Izaguirre
(74) *Attorney, Agent, or Firm*—Oliff & Berridge, PLC

(57) ABSTRACT

A sewing machine includes a needle plate having a needle hole through which a sewing needle is allowed to pass, a thread catcher reciprocally moved forward and backward below the needle plate and being elongated in a moving direction, the thread catcher having a frontward end with respect to a direction of forward movement of the thread catcher and including first and second generally hook-shaped catching portions, and a cutting blade located between the first and second catching portions at least during backward movement of the thread catcher to cut a thread caught between the first and second catching portions. The first catching portion is located nearer to the frontward end of the thread catcher than the second catching portion with respect to the moving direction of the thread catcher during forward movement of the thread catcher. The first catching portion is further spaced from and located nearer to the needle hole of the needle plate than the second catching portion with respect to a direction perpendicular to the moving direction of the thread catcher. The thread catcher is moved backward so that the thread caught between the first and second catching portions intersects the cutting blade.

9 Claims, 38 Drawing Sheets

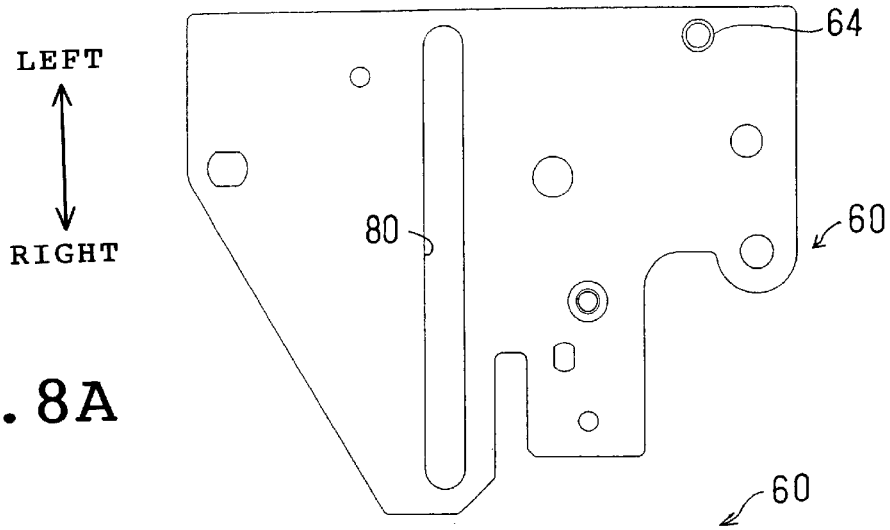
FIG.8A
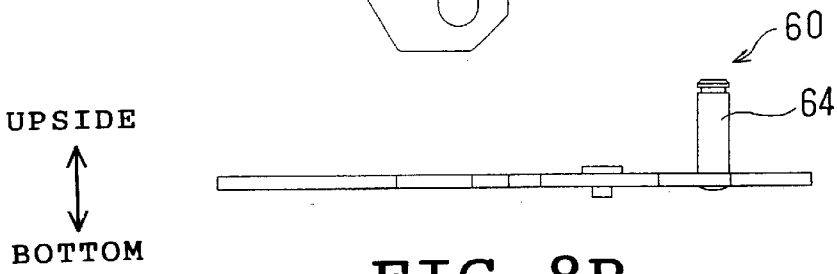
FIG.8B
FIG.8C FIG.8D FIG.8E
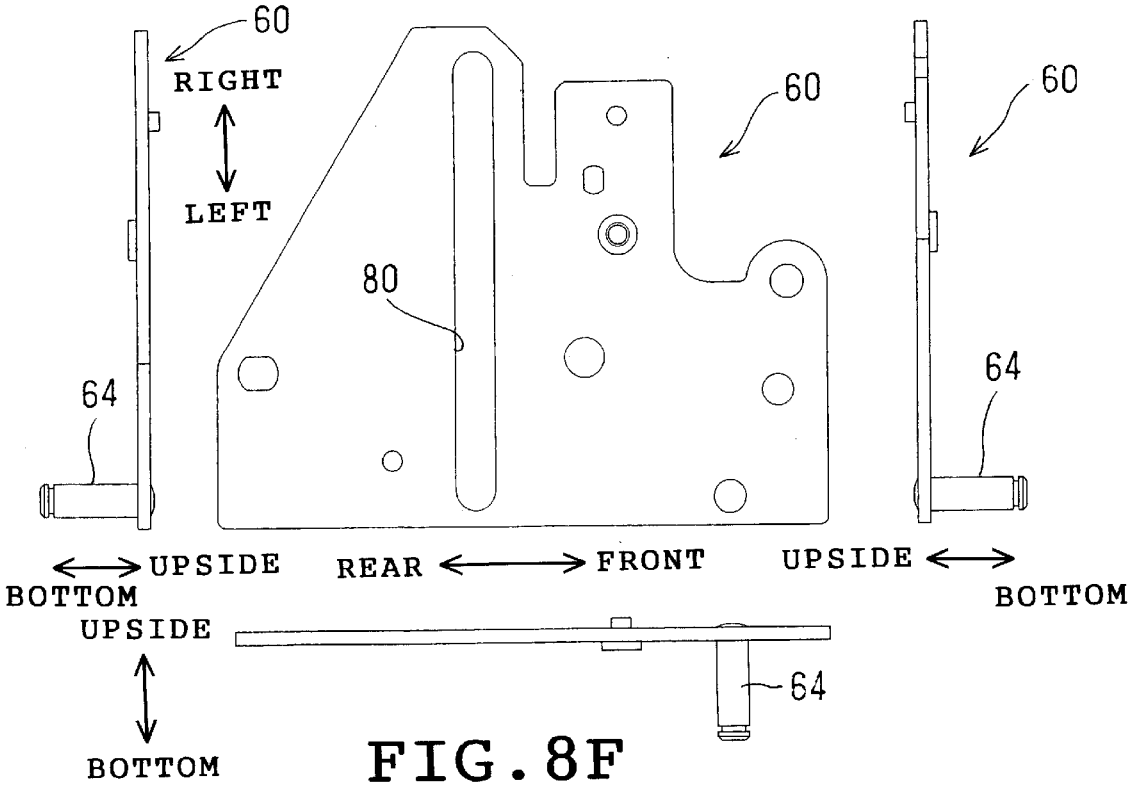
FIG.8F

FIG. 9A
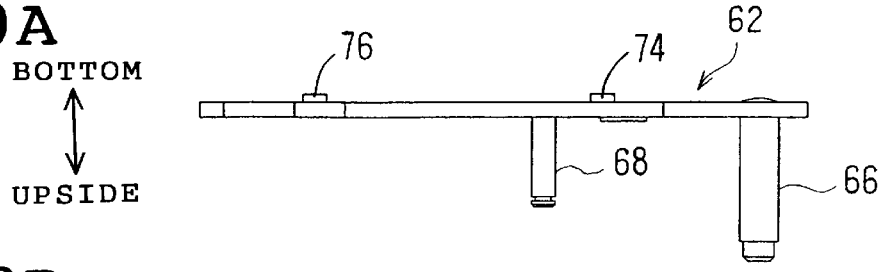
FIG. 9B
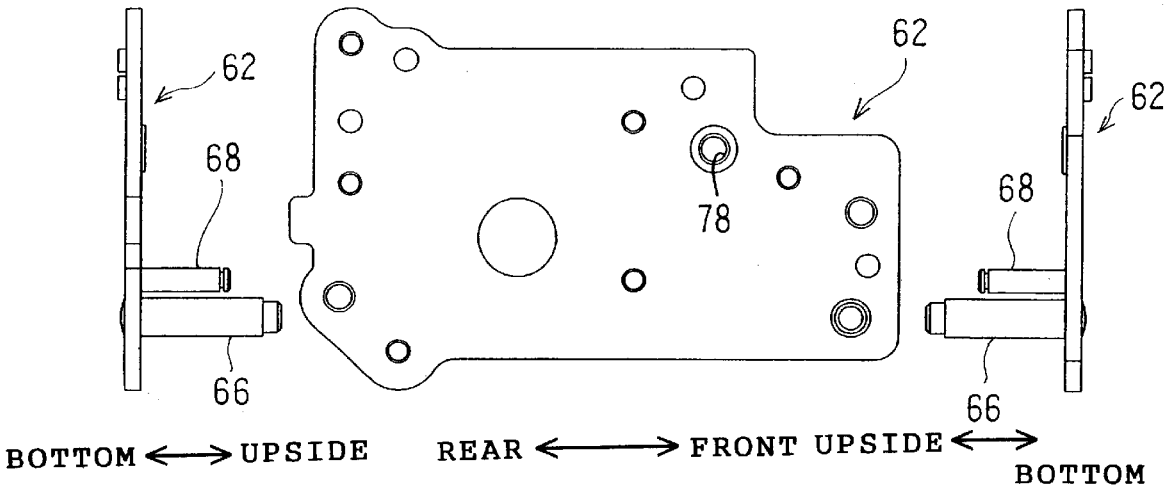
FIG. 9C FIG. 9D
FIG. 9E
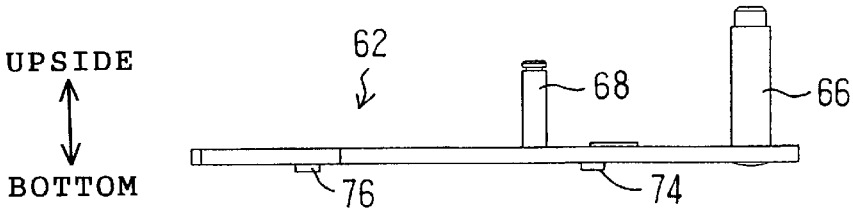
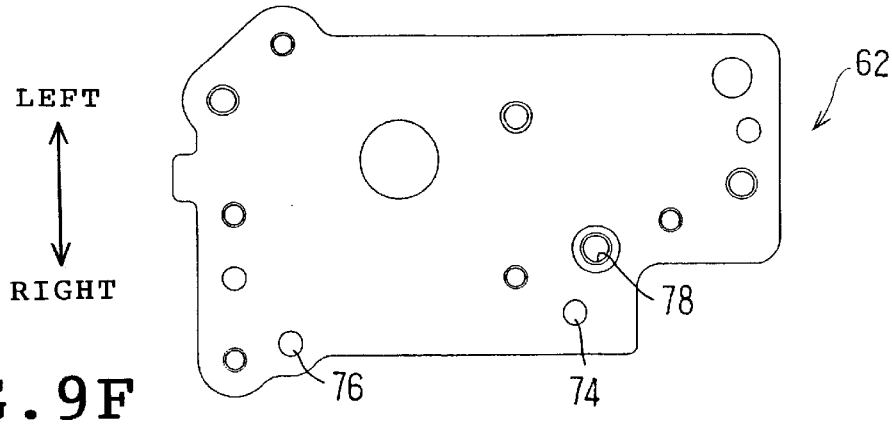
FIG. 9F FIG. 10A
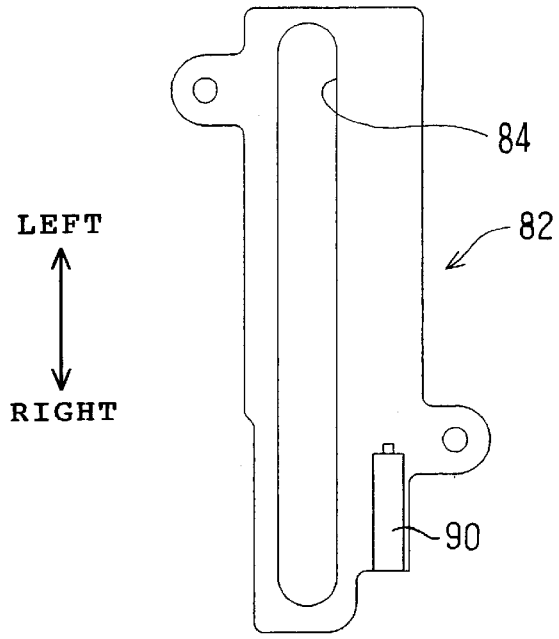
FIG. 10B
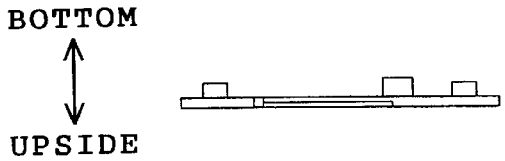
BOTTOM ⟷ UPSIDE
FIG. 10D
FIG. 10E
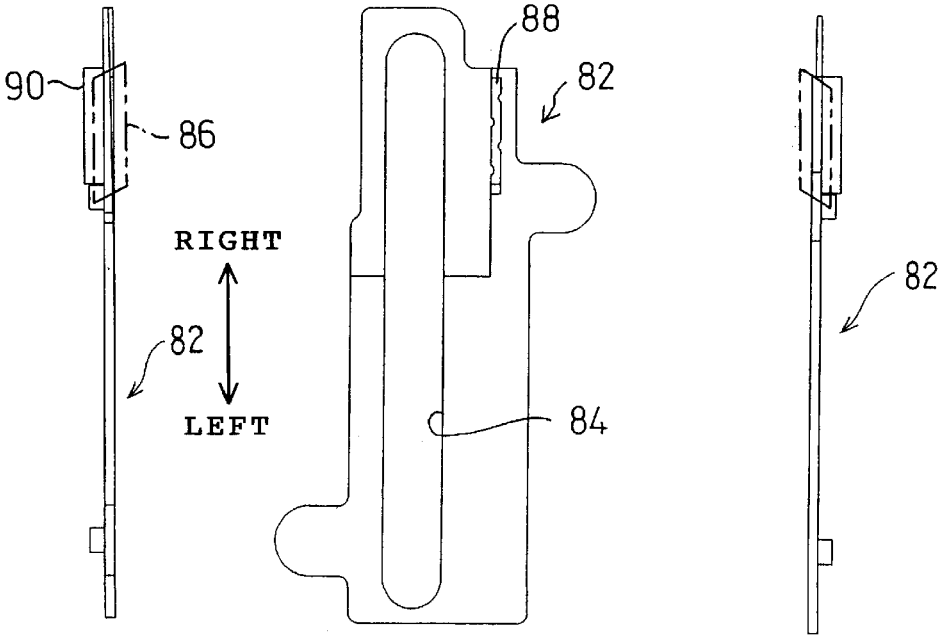
FIG. 10C
REAR ⟷ FRONT
UPSIDE ⟷ BOTTOM
FIG. 10F
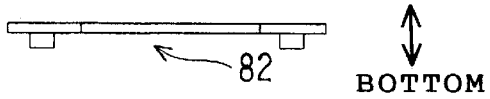

BOTTOM
UPSIDE

UPSIDE
BOTTOM
UPSIDE
BOTTOM

LEFT
RIGHT

FRONT
REAR

BOTTOM
UPSIDE

REAR
FRONT
92
94
96
100
102
104
106
108

FIG.13A
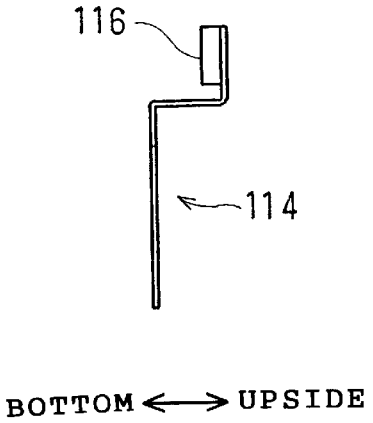
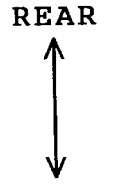
FIG.13B
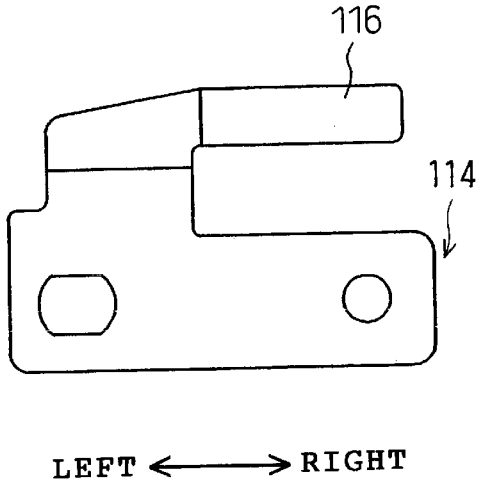
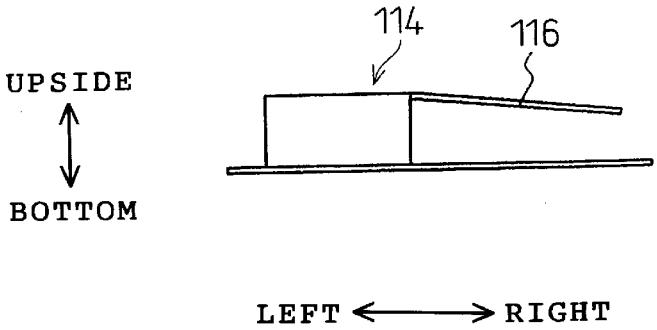
FIG.13C

FIG. 17A
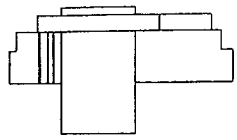
FIG. 17B
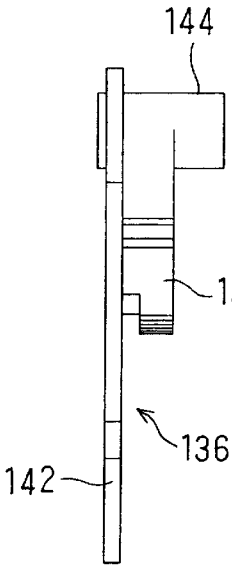
FIG. 17C
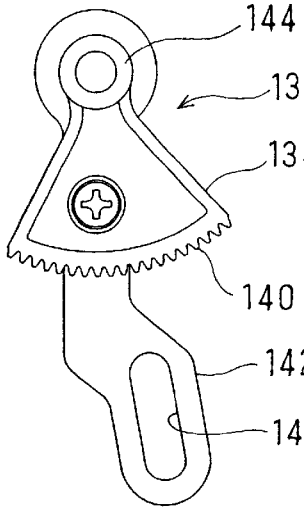
FIG. 17D
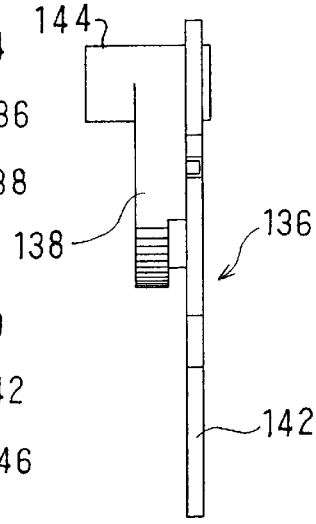
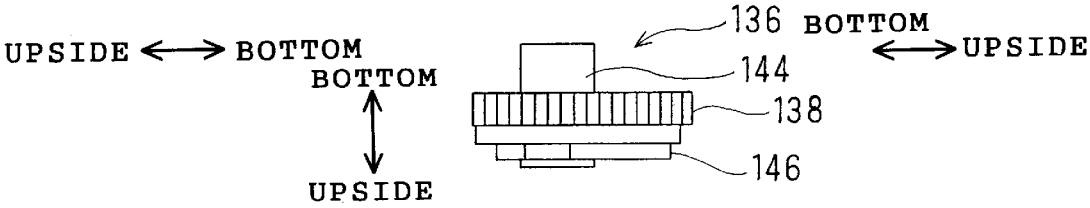
FIG. 17E
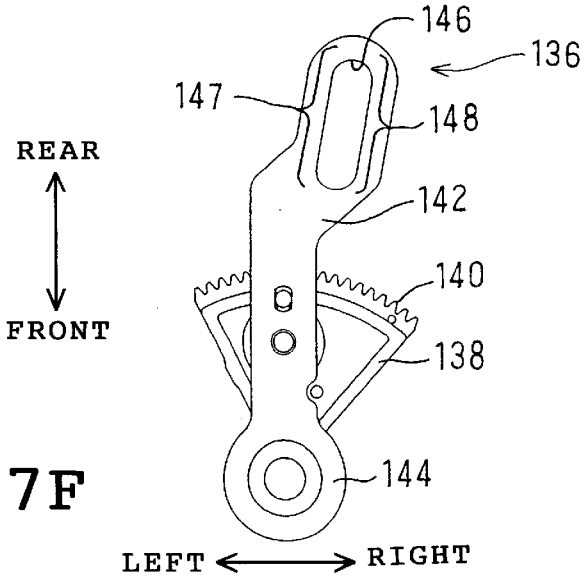
FIG. 17F

SEWING MACHINE WITH IMPROVED THREAD CUTTING MECHANISM

BACKGROUND OF THE INVENTION

1. Field of the Invention

This invention relates to a sewing machine in which a thread is caught below a needle plate to be cut by a cutting blade.

2. Description of the Related Art

Conventional sewing machines comprise a thread catcher provided to be reciprocally moved below a needle plate. The thread catcher is moved so as to pass through a thread loop, whereby the thread loop is divided by the thread catcher. The thread catcher catches the thread during its return movement. The caught thread is moved to the cutting blades to be cut. Japanese Patent No. 2871201 granted to the assignee of the present application discloses such a thread cutting manner. In the aforesaid conventional sewing machine, a moving blade 510 serving as the thread catcher and a fixed blade 520 comprise respective horizontally extending plate-like members, as shown in FIG. 42. The thread is divided by the fixed blade 520. A thread amount of a thread end at a cloth side in a sewing bed depends upon the location of a needle hole of the needle plate, the location of the fixed blade 520, the location of a bobbin for a bobbin thread, a rotational locus of a thread seizing beak of a horizontally rotating shuttle, etc. A thread amount of a thread end at a needle or bobbin side also depends upon these factors.

However, there is a possibility that the thread end at the cloth side may be entangled in the sewing bed when a thread amount of the thread end at the cloth side is larger upon thread cutting. In order that the thread end at the cloth side may be prevented from being entangled, the fixed blade is moved forward to be fixed at a position so that a thread amount of the thread end at the cloth side is reduced after thread cutting. In this case, however, a thread amount of the thread end at the needle side is reduced such that an amount of thread for subsequent sewing after thread cutting becomes short. Accordingly, in the conventional sewing machines, the thread ends at the cloth and needle sides cannot be maintained in suitable amounts after thread cutting, respectively.

SUMMARY OF THE INVENTION

Therefore, an object of the present invention is to provide a sewing machine in which both thread ends at the cloth and needle sides can be maintained in suitable amounts after thread cutting, respectively.

The present invention provides a sewing machine comprising a needle plate having a needle hole through which a sewing needle is allowed to pass, a thread catcher reciprocally moved forward and backward below the needle plate and being elongated in a moving direction, the thread catcher having a frontward end with respect to a direction of forward movement of the thread catcher and including first and second generally hook-shaped catching portions, the first catching portion being located nearer to the frontward end of the thread catcher than the second catching portion with respect to the moving direction of the thread catcher during forward movement of the thread catcher, the first catching portion being further spaced from and located nearer to the needle hole of the needle plate than the second catching portion with respect to a direction perpendicular to the moving direction of the thread catcher, and a cutting blade located between the first and second catching portions at least during backward movement of the thread catcher to cut a thread caught between the first and second catching portions. In this construction, the thread catcher is moved backward so that the thread caught between the first and second catching portions intersects the cutting blade.

In the foregoing sewing machine, the first and second catching portions of the thread catcher are located at different positions with respect to the direction in which the thread catcher is moved forward. Accordingly, when the thread caught by the first and second catching portions is cut by the cutting blade, two parts of the thread cut have respective suitable lengths.

BRIEF DESCRIPTION OF THE DRAWINGS

Other objects, features and advantages of the present invention will become clear upon reviewing the following description of an embodiment, made with reference to the accompanying drawings, in which:

FIGS. 8A to 8F are bottom, right side, rear, plan, front and left side views of a thread cutter base upper plate respectively;

FIGS. 9A to 9F are right side, rear, plan, front left side and bottom views of a thread cuter base lower plate respectively;

FIGS. 10A to 10F are bottom, right side, rear, plan, front and left side views of a guide member respectively;

FIGS. 13A to 13C are left side, plan and front views of a thin plate respectively;

FIGS. 17A to 17F are front, left side, bottom, right side, rear and plan views of a thread cutting lever respectively;

DETAILED DESCRIPTION OF THE INVENTION

Figure 1A:
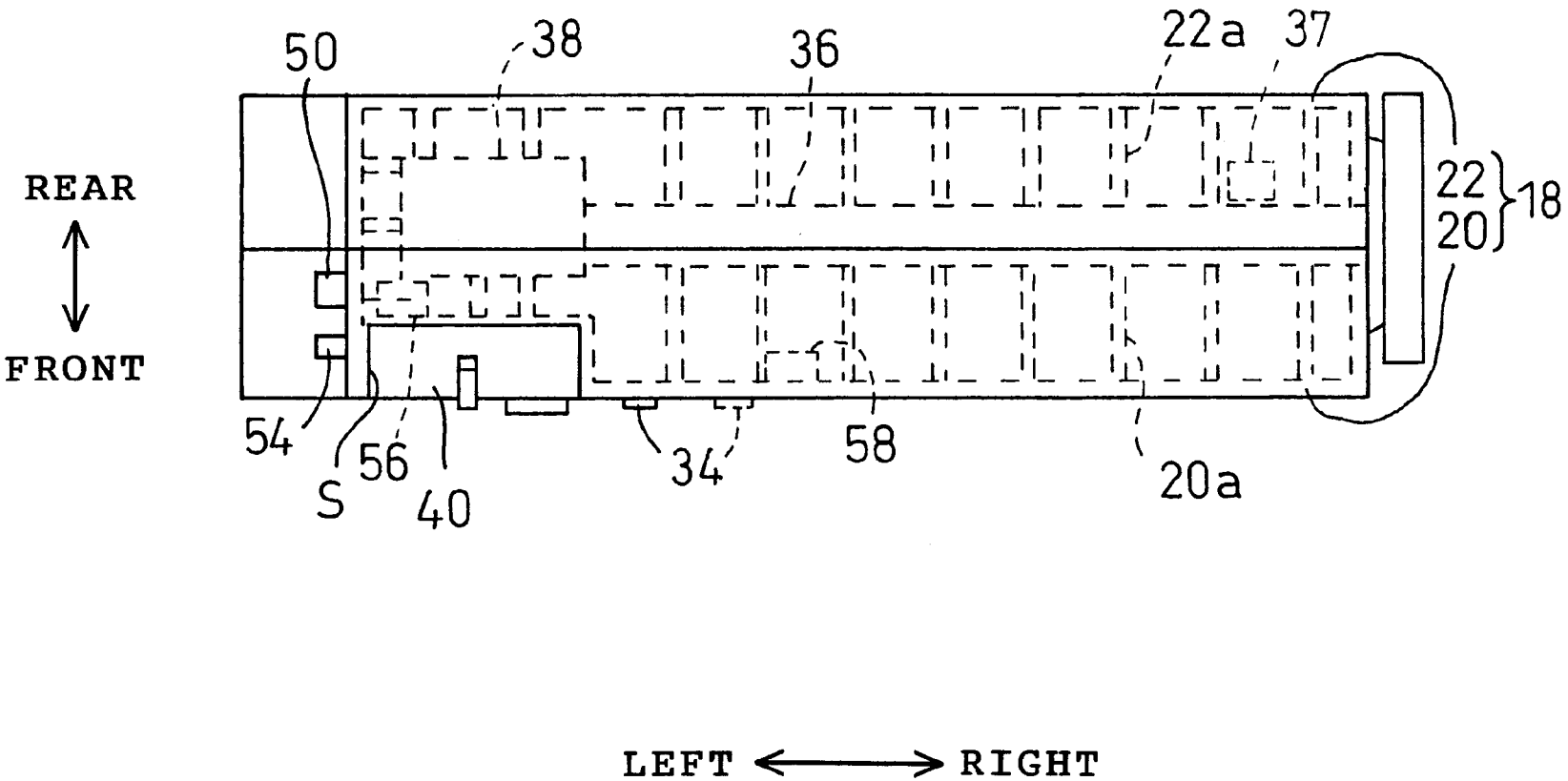
FIGS. 1A and 1B are a plan view and a front view of a sewing machine in accordance with one embodiment of the invention.
Figure 1B:
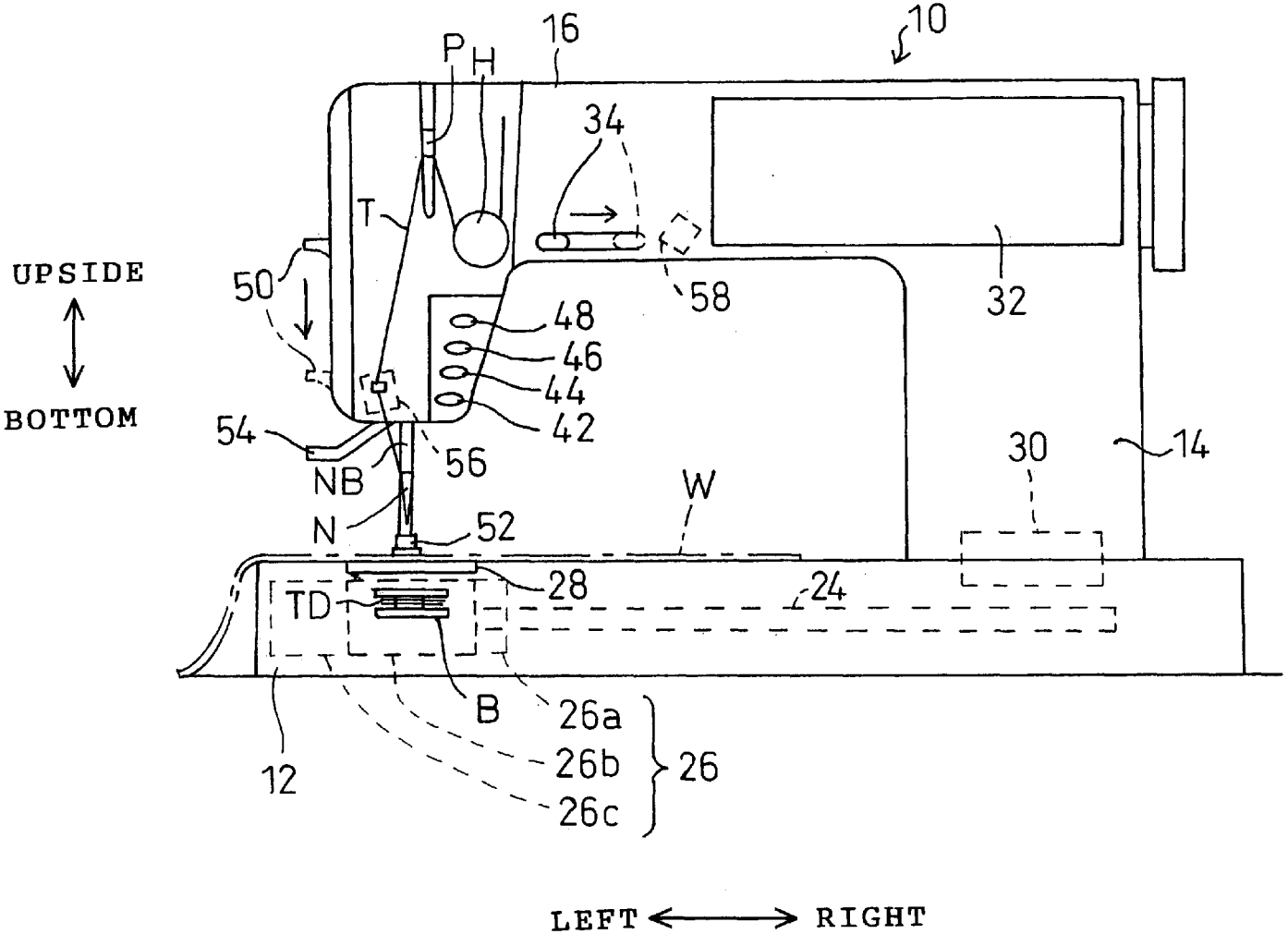

One embodiment of the invention will be described in detail with reference to the accompanying drawings. Referring to FIGS. 1A and 1B, a sewing machine 10 in accordance with the invention comprises a sewing bed 12 having a horizontal plane, a pillar 14 extending upward from a right-hand portion of the bed 12 and a sewing arm 16 extending horizontally rightward from the pillar 14 so as to be opposed to the bed 12 or located over the bed. The bed 12, pillar 14 and arm 16 are formed continuously on a resin frame 18 including a front frame 20 and a rear frame 22. Japanese Patent Application No. 2001-295564 filed by the assignee of the present application discloses such a frame as described above.

Figure 24:
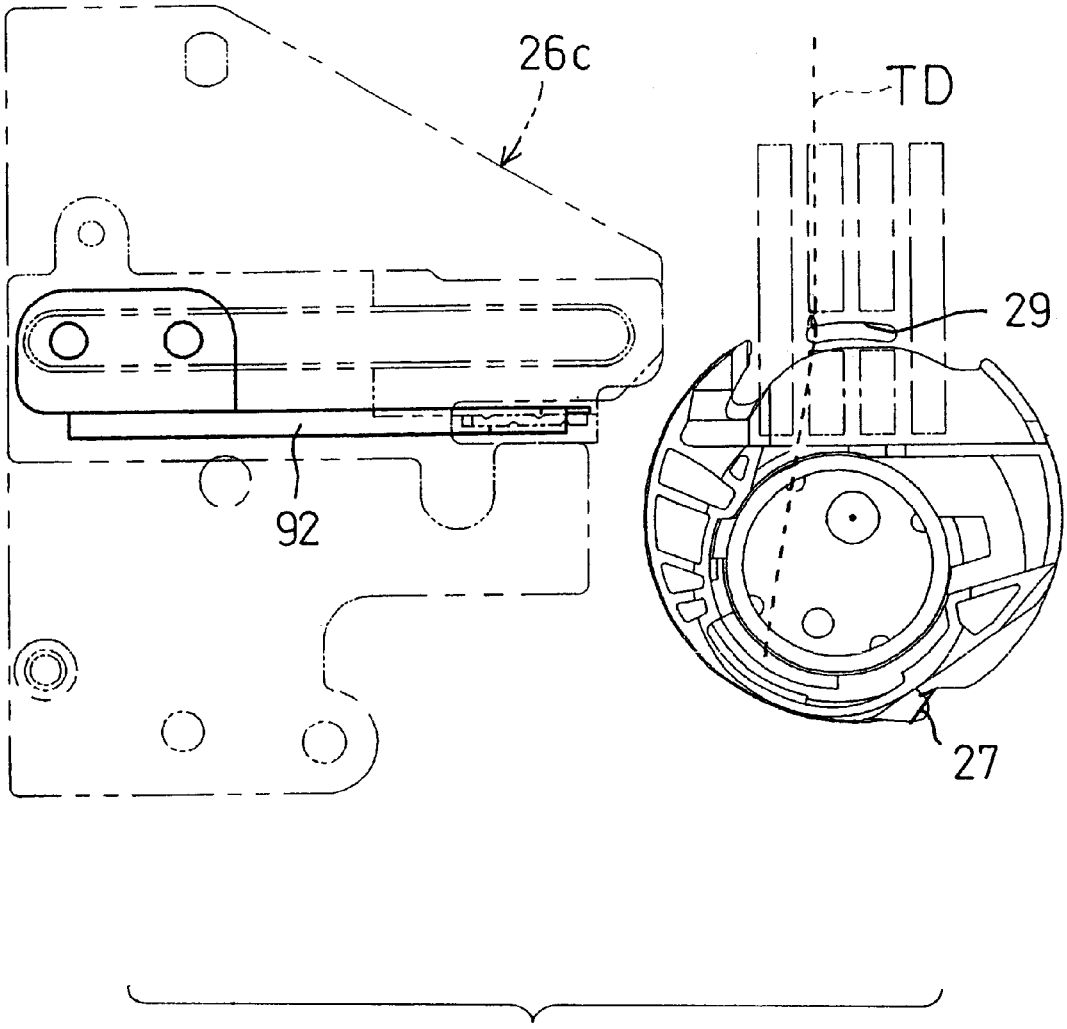
FIG. 24 is a plan view of the thread cutting mechanism in the case where the thread catcher assumes a stand-by position.
Figure 25:
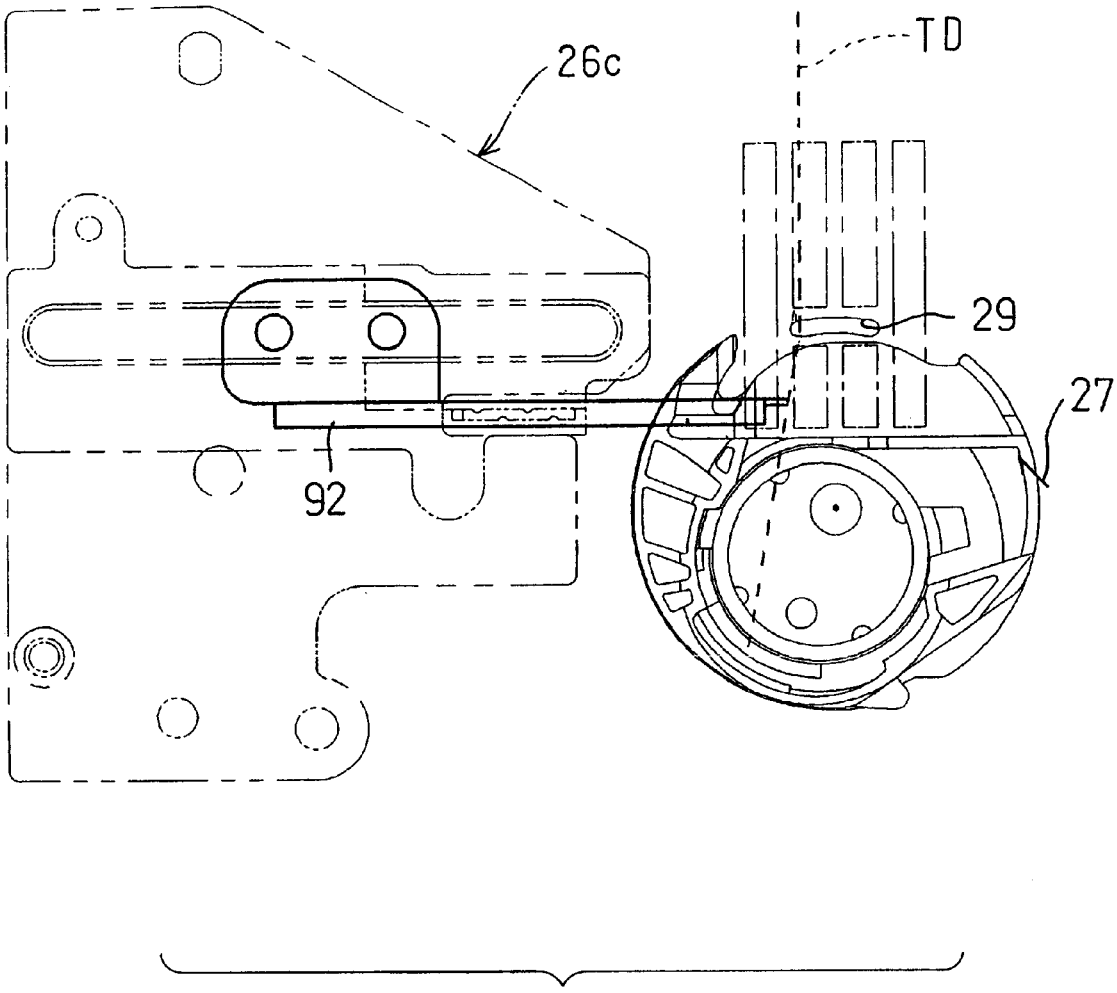
FIG. 25 is a plan view of the thread cutting mechanism in the case where the thread catcher gets over the bobbin thread.

A lower shaft 24 made from a metal is supported on the rear frame 22 so as to extend lengthwise inside the bed 12 as viewed in FIG. 1B. A lower mechanism 26 is mounted on the rear frame 22 at a left-hand end of the shaft 24. The lower mechanism 26 comprises a feed dog mechanism 26*a* moving a feed dog 25 back and forth and including one or more metal components, a thread loop catching mechanism (horizontal shuttle mechanism) 26*b* rotating a loop seizing beak 27 about a vertical line on a horizontal plane around a bobbin B, a thread cutting mechanism $^{2}$6*c* cutting a needle thread TU and a bobbin thread TD. A needle plate 28 is mounted on a portion of the frame 18 located over the thread loop catching mechanism 26*b* or the lower mechanism 26 as shown in FIG. 1B. The needle plate 28 is formed with a needle hole 29 allowing a needle N moved up and down to pass therethrough, as shown in FIG. 24. A machine motor 30 is provided in a boundary between the bed 12 and pillar 14. The motor 30 serves as a drive source for the lower shaft 24, feed dog mechanism 26*a*, thread loop catching mechanism 26*b* and mechanisms provided in the arm 16.

Figure 41A:
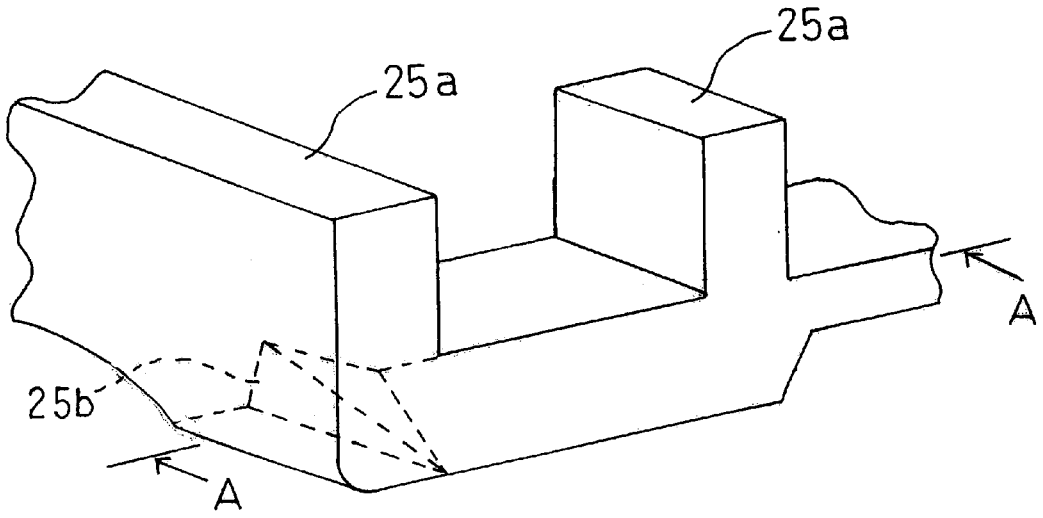
FIGS. 41A and 41B are an enlarged perspective view of the feed dog and a view taken along line 41B—41B in FIG. 41A.
Figure 41B:
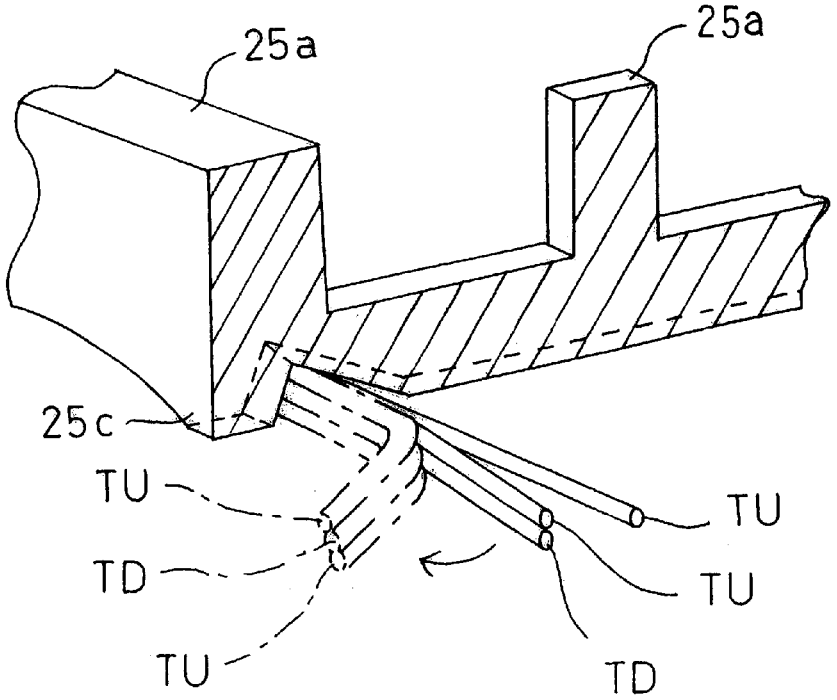
Figure 42:
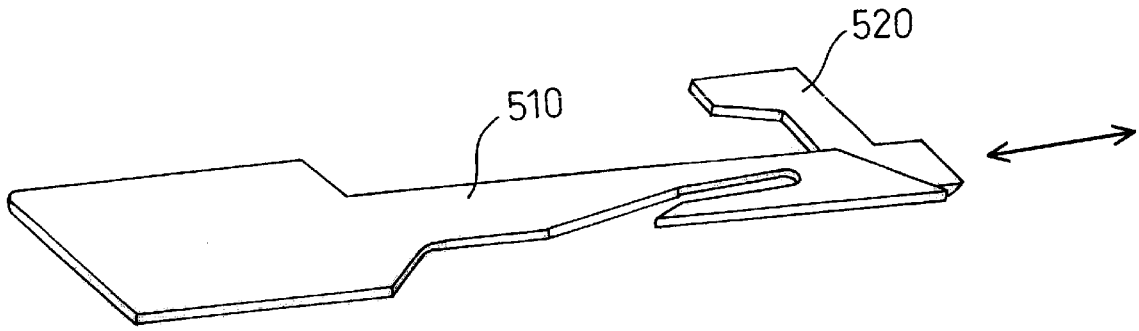
FIG. 42 is a perspective view of a conventional thread cutting mechanism.

The feed dog 25 has a generally rectangular through opening formed in a front portion thereof. Upwardly protruding teeth 25*a* are formed around the opening. The feed dog 25 further has a notch 25*b* formed in a front end of the underside thereof. The notch 25*b* has a generally triangular section and upwardly recessed as viewed in FIG. 41B. The recess has a depth gradually increased as it goes rearward. The notch 25*b* has two inclined faces and a downwardly protruding portion 25*c* formed to the left of the notch 25*b*.

A transparent touch panel 32 with a liquid crystal display or LCD is provided over both the pillar 14 and the arm 16 so that a desired embroidery pattern is selected thereon and an automatic thread cutting is set when sewing is started and finished. A slidable operating member 34 is provided on a front face of the arm 16 so as to be located on the left of the touch panel 32, as viewed in FIG. 1B. The operating member 34 is operated to set a rotational speed of the motor 30. When the operating member 34 is slid to assume a position shown by broken line in FIG. 1B, the motor 30 is rotated at high speeds.

A main shaft 36 made of a metal is mounted on the rear frame 22 made from a resin in the arm 16. The main shaft 36 extends lengthwise inside the arm 16 as viewed in FIG. 1A. A status detector 37 is provided for detecting an angle and a rotational speed of the main shaft 36. The status detector 37 comprises a photocoupler or signal generator interrupted by a shutter or slit disk fixed to the main shaft 36.

An upper mechanism 38 is supported on the resin rear frame 22 at a left-hand end of the main shaft 36. The upper mechanism 38 includes a needle bar driving mechanism including one or more metal components, presser foot lifting mechanism, needle thread take-up driving mechanism for moving a needle thread take-up P up and down in a suitable phase relative to a needle bar NB, threading mechanism, etc. The needle thread take-up driving mechanism also includes both a mechanism for moving the needle N up and down and a mechanism for swinging the needle N right and left and further comprises a stepping motor serving as a drive source discrete from the motor 30. The aforesaid stepping motor is used to open a tension disk H for the bobbin thread TU in synchronization with thread cutting as well as to drive the needle thread take-up driving mechanism.

An attachment portion S is formed in a left-hand end front of the arm 16. The attachment portion S extends vertically and is recessed rearward. A thread cassette 40 serving as a needle thread source is attached to the attachment portion S. Japanese Patent Application No. 2000-398266 filed by the assignee of the present application discloses such a sewing machine provided with a thread cassette detachably attached thereto.

The front face of the arm 16 includes a portion below a bent portion of the thread cassette 40, in which portion are provided a start/stop or S/S button 42 for starting and stopping the motor 30, a reverse stitching button 44 or backtacking button, a needle position switching button 46 for switching the needle N between upper and lower stop positions, and thread cutting button 48 for cutting the bobbin thread TU and the needle thread TD at a desired time. A threading lever 50 is provided on a left side of the arm 16 for threading the needle N with the needle thread TU. A presser foot operating lever 54 is provided on the lower portion of the arm 16 for moving a presser foot 52 upward or downward. The arm 16 includes an underside formed with two, right-hand and left-hand, openings in which illuminating devices 56 and 58 are provided respectively.

An overall construction of the thread cutting mechanism 26*c* will now be described with reference to FIGS. 2 to 7 and components of the mechanism will be described with reference to FIGS. 8A to 17F. Referring first to FIGS. 8A to 9F, an upper thread cutter base plate 60 and a lower thread cutter base plate 62 are shown both of which are metal plates and on both of which various components are mounted respectively. Each of the plates 60 and 62 is formed with a large number of through holes and female screws both of which are used to mount the components.

Figure 2:
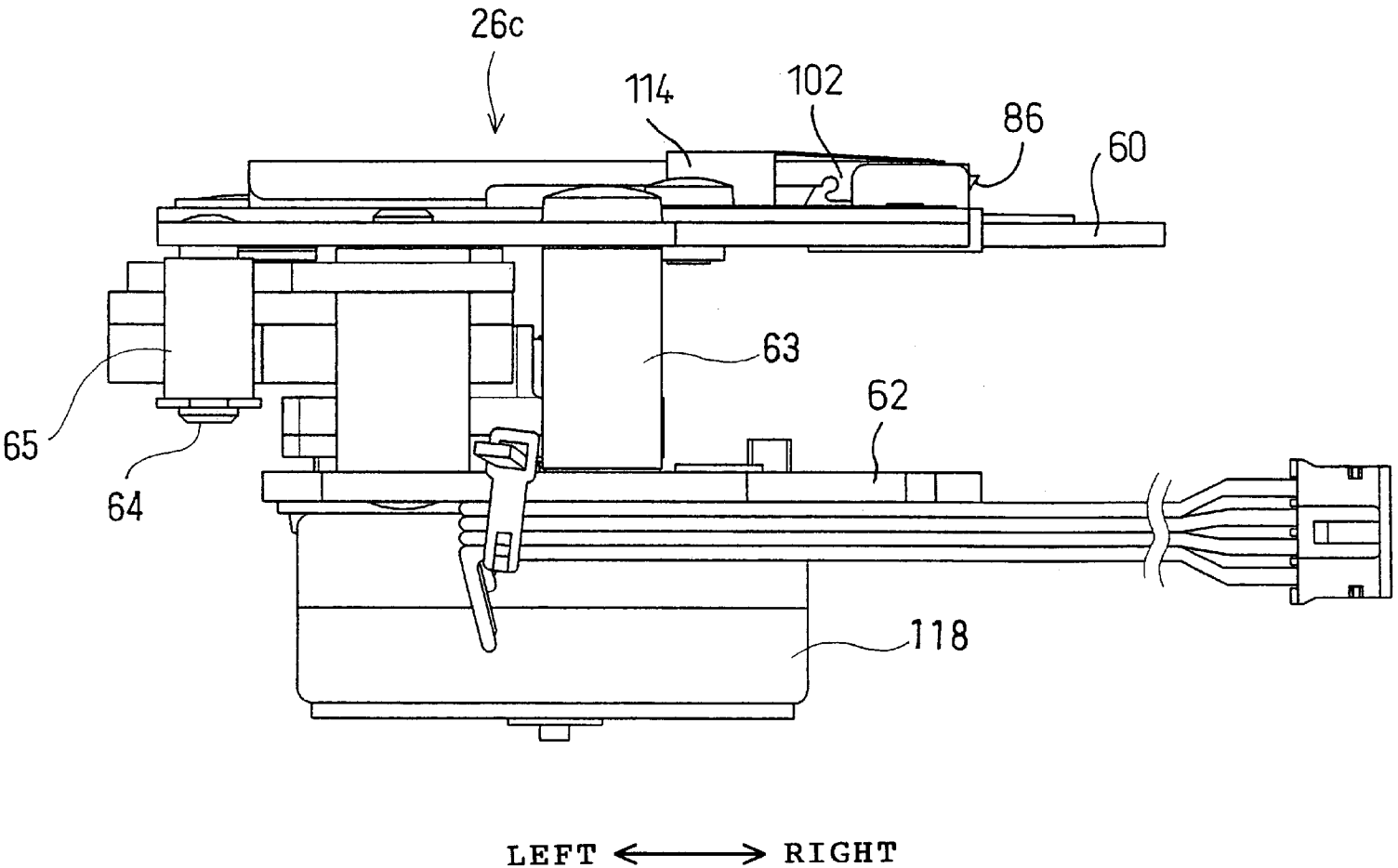
FIG. 2 is a front view of a thread cutting mechanism.
Figure 5:
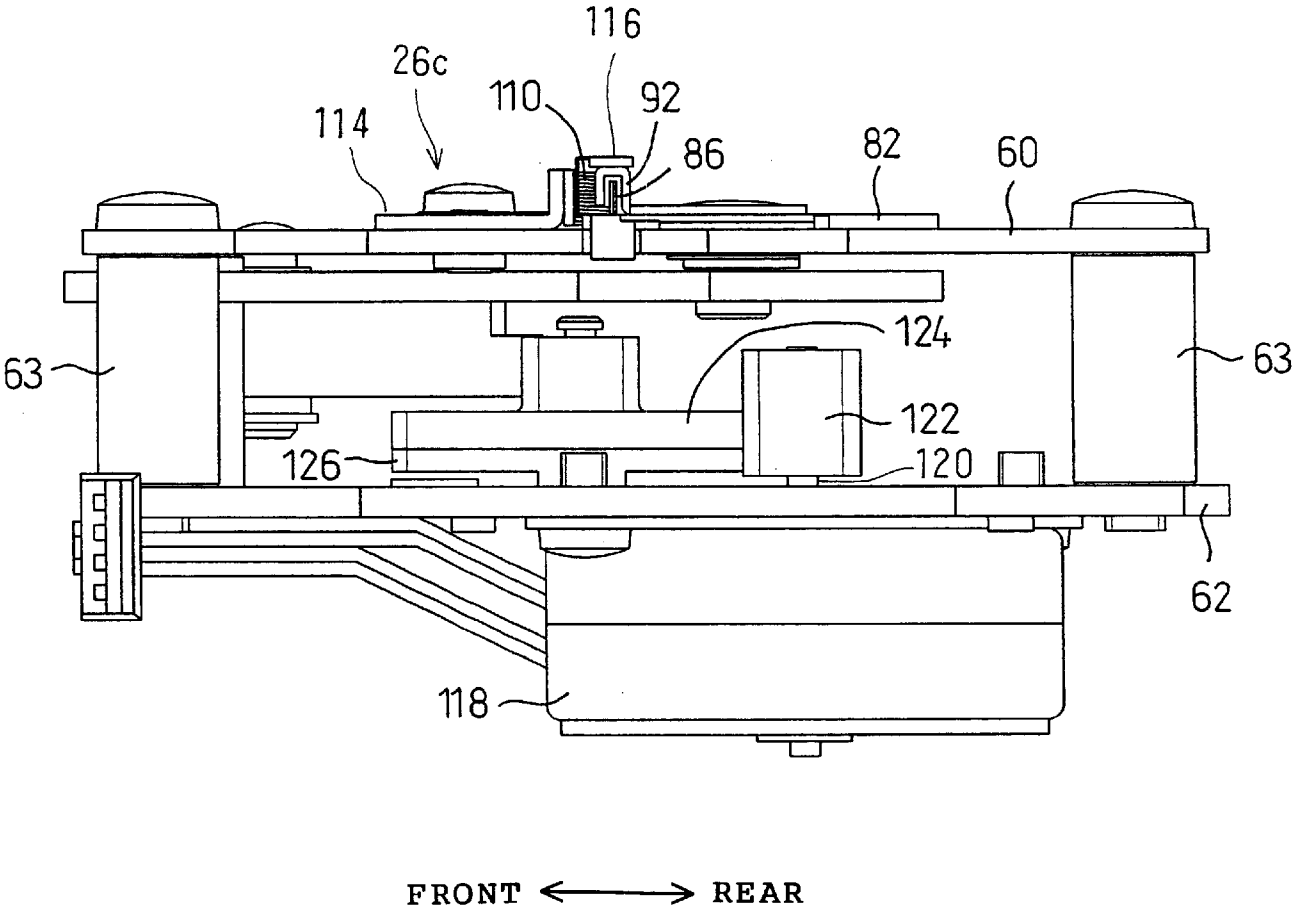
FIG. 5 is a right side view of the thread cutting mechanism.
Figure 6:
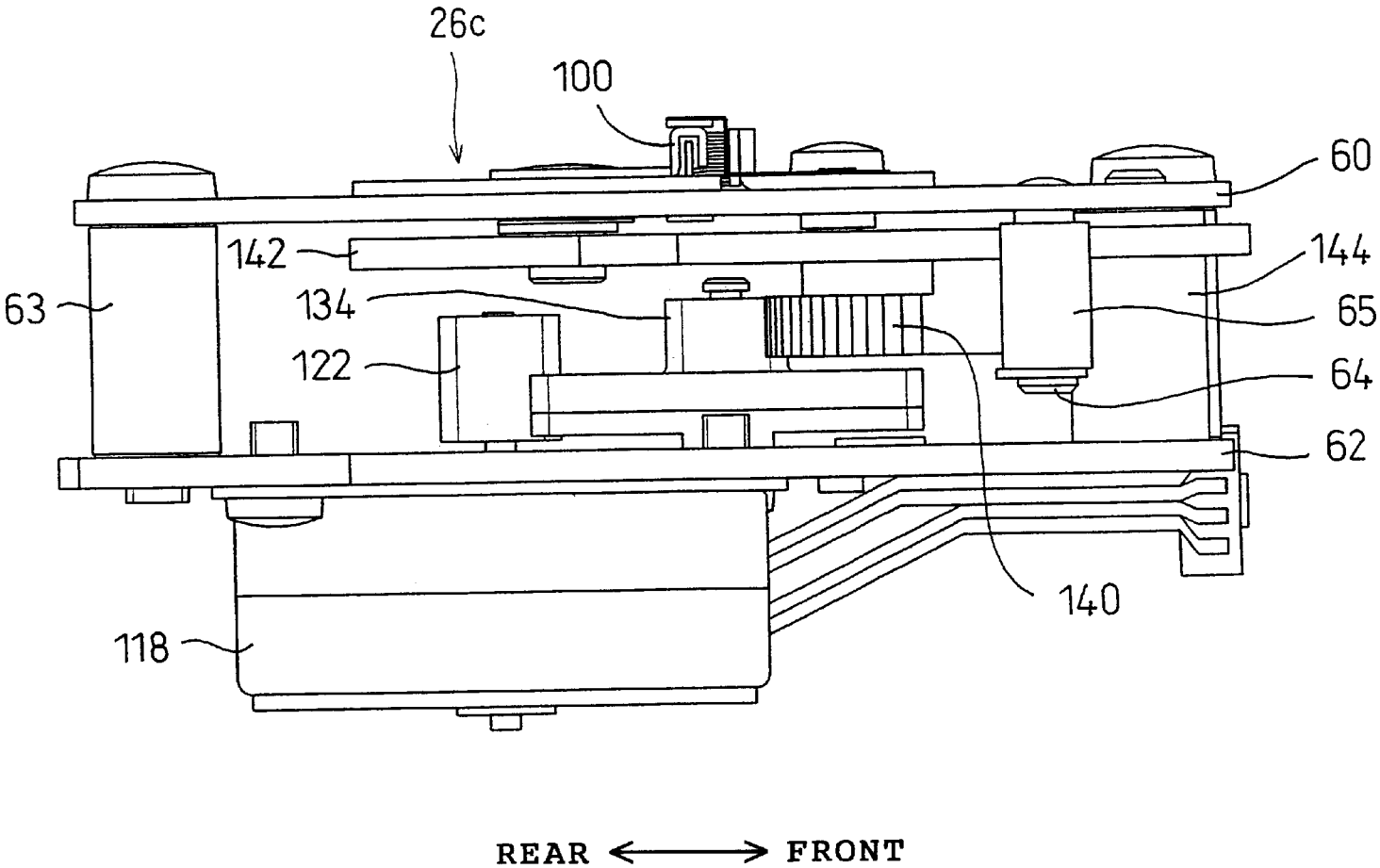
FIG. 6 is a left side view of the thread cutting mechanism.

Two metal cylindrical spacers 63 are screwed on the upper and lower plates 60 and 62 as shown in FIGS. 5 and 6, whereupon the plates 60 and 62 are spaced vertically horizontally from each other. Thus, a space in which various components are located as will be described later is defined between the plates 60 and 62 as shown in FIG. 2 and the like. An origin detecting pin 64 is fixed to the upper plate 60 so as to protrude downward. An elastic member 65 made from, for example, hard rubber is mounted to the pin 64 so as to cover a circumferential side thereof. Two metal cylindrical support pins 66 and 68 are mounted on the lower plate 62 to upwardly protruding other components as shown in FIGS. 9A to 9F. Furthermore, a downwardly protruding rotational shaft pin 74 and an abutment pin 76 are fixed to the lower plate 62 as shown in FIGS. 9A to 9F. The pins 74 and 76 are formed into substantially the same cylindrical shape and made from a metal. The pins 74 and 76 may be embossed downward although separated from each other. The thread cutting mechanism 26*c* is rotatable about the pin 74 when a lower portion of the pin 74 is inserted into a recess formed in the left front of a horizontal metal base plate (not shown) of the thread loop catching mechanism 26*b*.

The abutment pin 76 assumes a position where the pin abuts on a left rear end of the base plate of the thread loop catching mechanism 26*c* when the thread cutting mechanism 26*c* is rotated about the pin 74. As a result, an opening of a screw hole 78 (female screw) formed in the thread cutter base lower plate 62 is superposed on a through hole formed in the base plate of the thread loop catching mechanism 26*b*. In this state, the lower plate 62 and the base plate of the mechanism 26*b* are allowed to be screwed, so that the thread cutting mechanism 26*c* and the thread loop catching mechanism 26*b* are fastened with screws.

The thread loop catching mechanism 26*b* has a vertical flat portion formed in the rear thereof. The flat portion has a lower end formed so as to correspond to the opening of the screw hole of the rear frame 22. The flat portion is located near the screw hole of the rear frame 22. A screw is inserted into the screw hole to be fastened, whereby the flat portion is sandwiched between the screw head and the rear frame 22. Thus, the thread cutting mechanism 26*c* is mounted on the thread loop catching mechanism 26*b* in a manner as described above, and the mechanism 26*b* is further mounted on the rear frame 22. Thus, the mechanisms 26*b* and 26*c* are completed as independent modules, which are further assembled together.

The thread cutter base upper plate 60 is formed with a sidewise elongated through hole 80 as shown in FIGS. 8A and 8D. A plate-shaped resin guide member 82 as shown in FIGS. 10A to 10F is fixedly fitted with the upper plate 60 so as to be located over the elongated hole 80, as shown in FIG. 5. The guide member 82 also has a sidewise elongated through guide hole 84, which is superposed on the inside of the elongated hole 80. Thus, the upper plate 60 is formed with a sidewise elongated vertically through hole.

The guide member 82 has a blade mounting groove 88 formed in the front right end of the guide hole 84 so as to be recessed downward. A generally parallelogrammic plate-shaped cutting blade 86 is vertically inserted into the blade mounting groove 88 while being elongated sidewise. A downwardly projecting blade cover 90 is provided so as to define the blade mounting groove 88, whereupon the blade cover 90 covers lower front and rear sides and right-hand portion of the blade 86. The cutting blade 86 has a blade portion located at a right end thereof. The blade mounting groove 88 is formed so as to extend longer leftward than the blade cover 90. Consequently, a workman can visually examine how deep the cutting blade 86 has been pushed downward. An acute corner of the blade 86 is not in contact with the guide member 82, whereas a lower side of the blade 86 in a lower obtuse portion thereof is in contact with the bottom of the groove 83. The distal end of the corner of the blade 86 is in contact with nothing. Accordingly, a mounting portion of the blade 86 has an improved stability.

Figure 3:
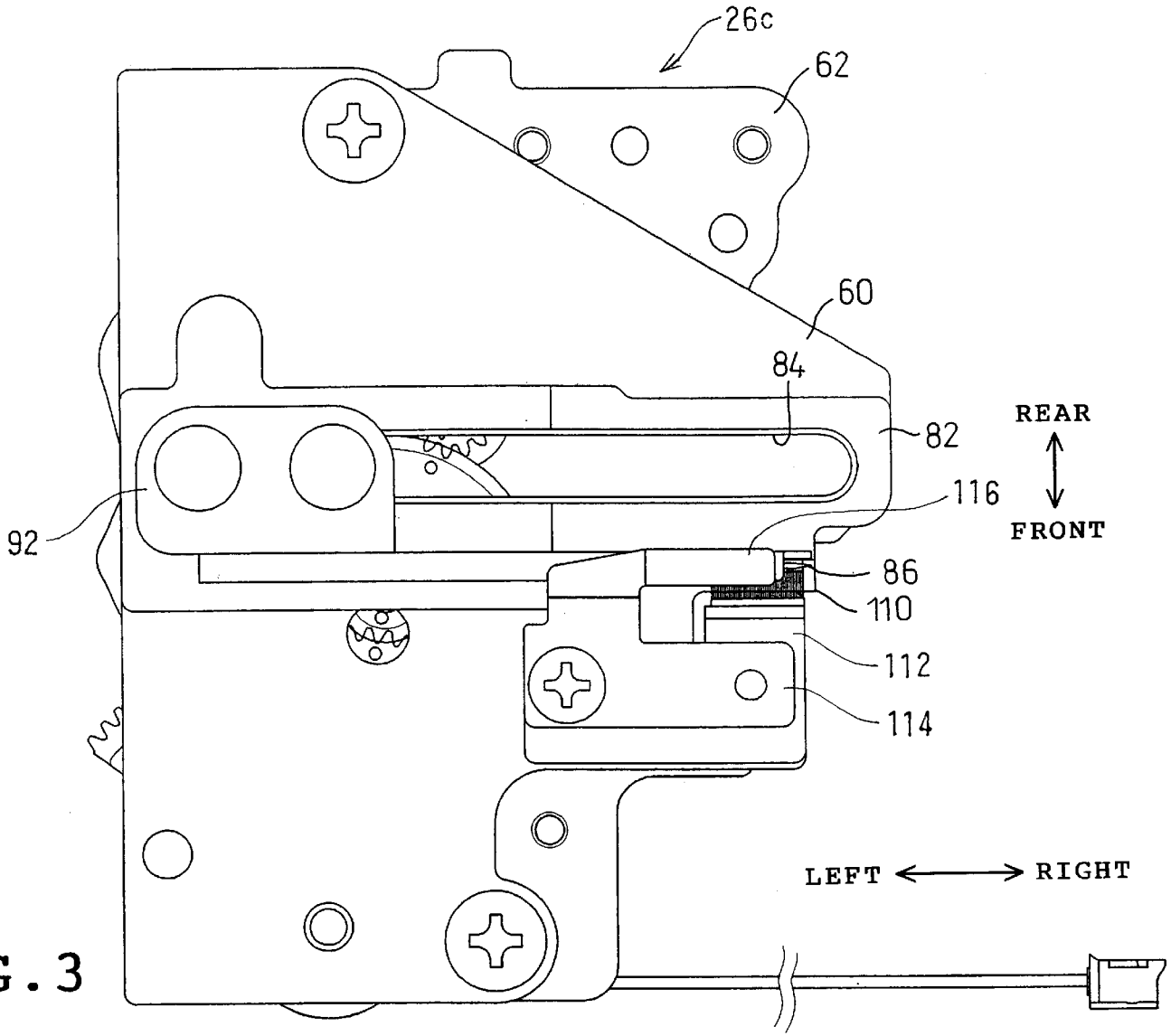
FIG. 3 is a plan view of the thread cutting mechanism.

A sidewise extending metal thread catcher 92 as shown in FIGS. 11A to 11F is disposed over the guide member 82. Two cylindrical metal guided portions 94 and 96 are provided on the left-hand rear of the thread catcher 92. The guided portions 94 and 96 protrude downward. Each guided portion has a diameter slightly smaller than a width of the guide hole 84, whereupon each guided portion is slidable along the inner circumferential face of the guide hole 84 when inserted into the hole. Thus, the thread catcher 92 is supported by the guide member 82 below the needle plate 28 so as to be slidable sidewise, as shown in FIG. 3. The left-hand guided member 94 protrudes lower than the guide member 82, reaching the space between the upper and lower plates 60 and 62

The thread catcher 92 includes a generally hook-shaped first thread catching portion 100 and a generally hook-shaped second thread catching portion 102. The first catching portion 100 is located on the right of the second catching portion 102 with respect to a direction in which the thread catcher 92 is moved forward and rearward in its reciprocal movement. Furthermore, the first thread catching portion 100 is located nearer to the needle hole 29 than the second thread catching portion 102 with respect to a direction generally perpendicular to the direction in which the thread catcher 92 is reciprocally moved and spaced from the needle hole 29. Additionally, the first and second thread catching portions 100 and 102 constitute vertical planes respectively and are parallel with each other.

Figure 7:
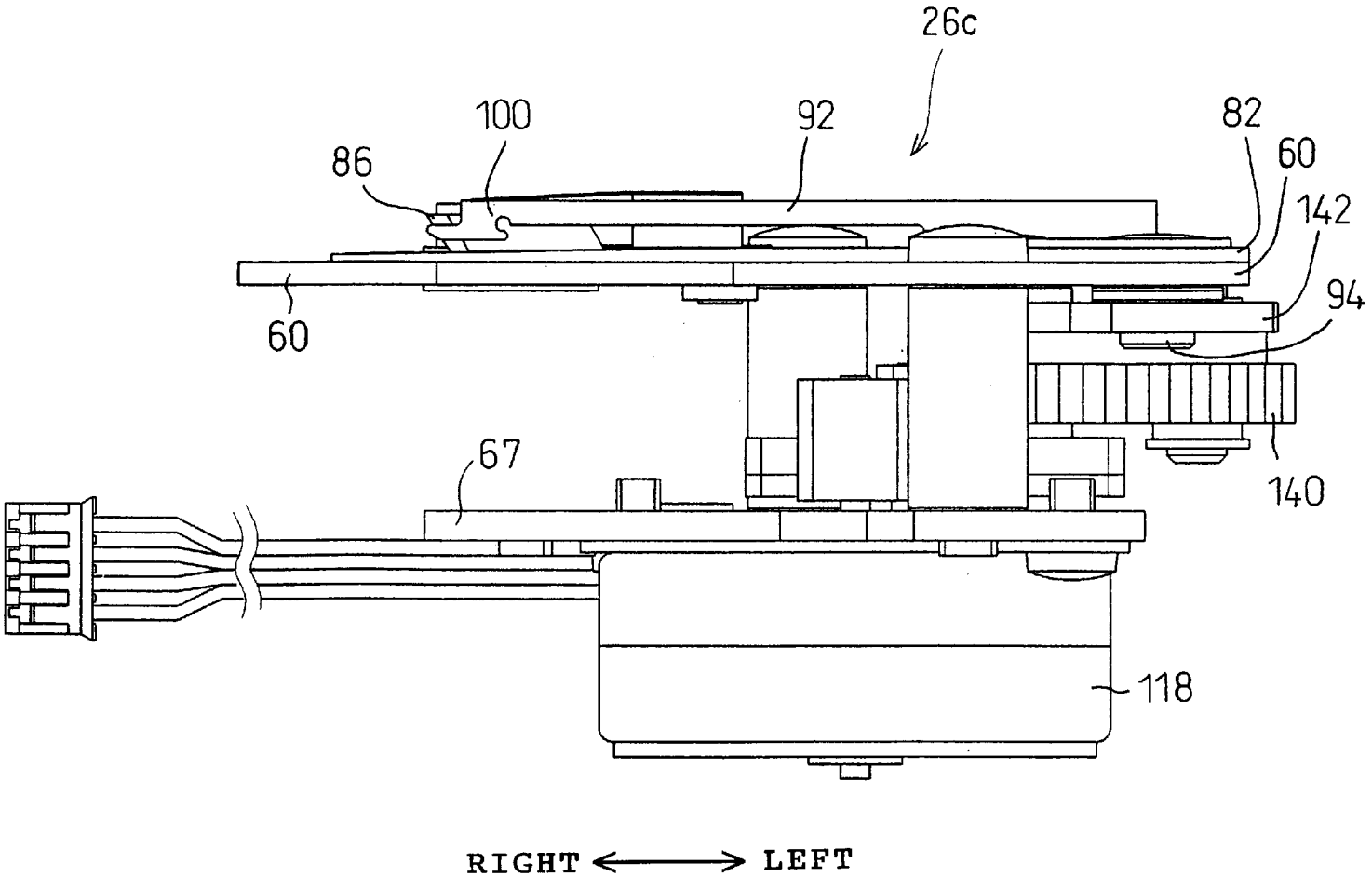
FIG. 7 is a rear view of the thread cutting mechanism.
Figures 11A, 11B, 11C, 11D, 11E, 11F:
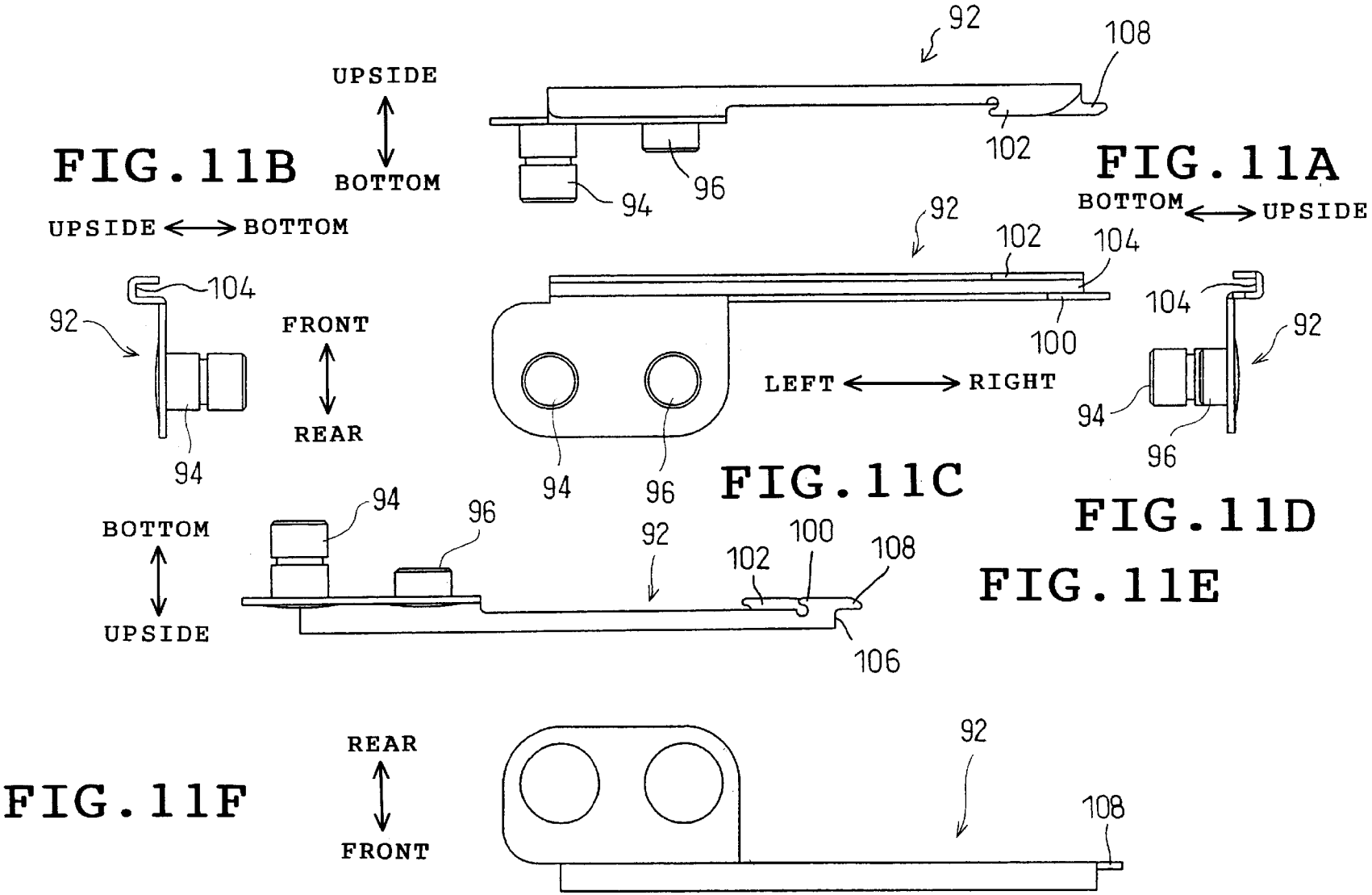
FIGS. 11A to 11F are front, left side, bottom, right side, rear and plan views of a thread catcher respectively.
Figure 12B:
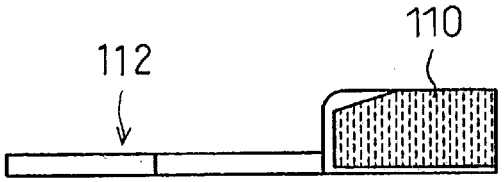
FIGS. 12A to 12C are right side, rear and plan views of a cut thread holding member respectively.
Figure 12C:
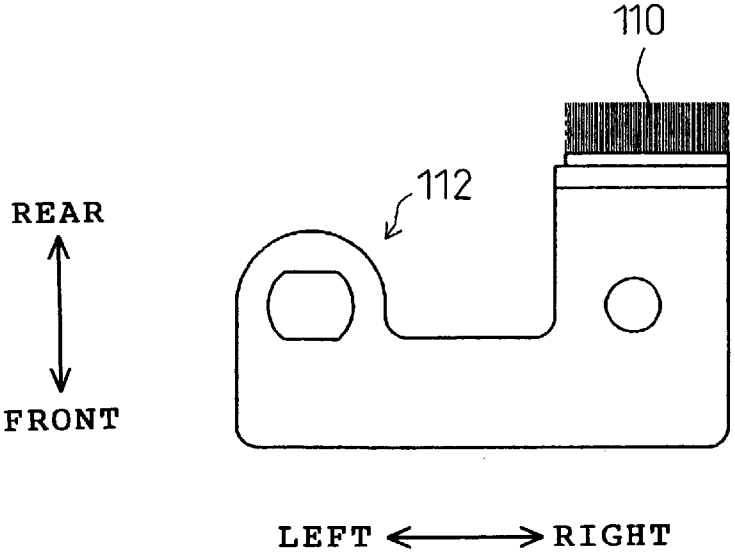
Figure 12A:
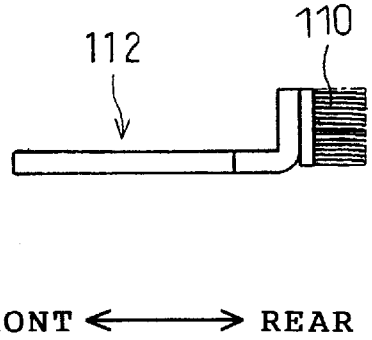
Figure 14A:
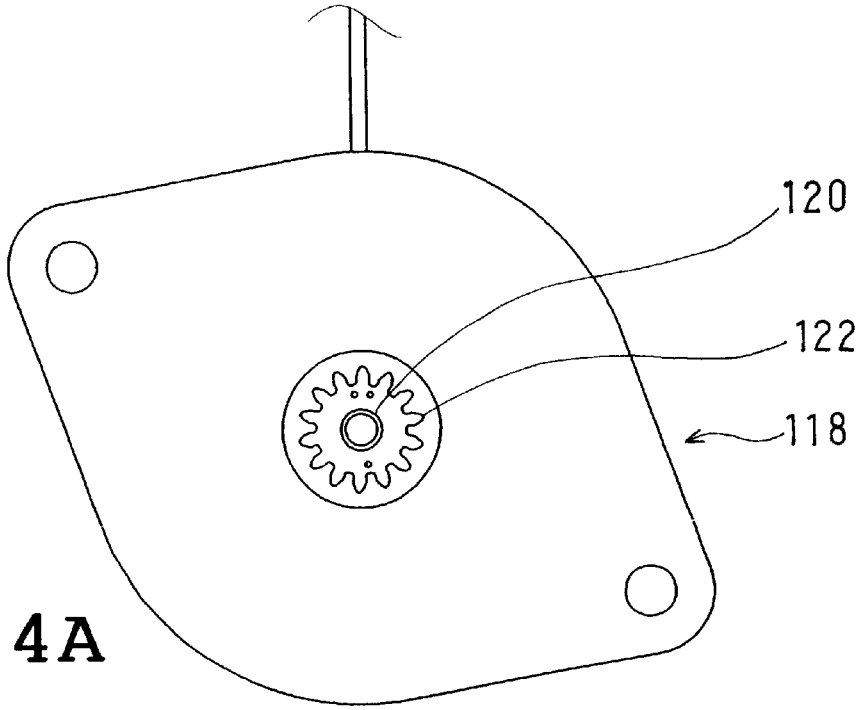
FIGS. 14A and 14B are plan and front views of a thread cutting stepping motor of respectively.
Figure 14B:
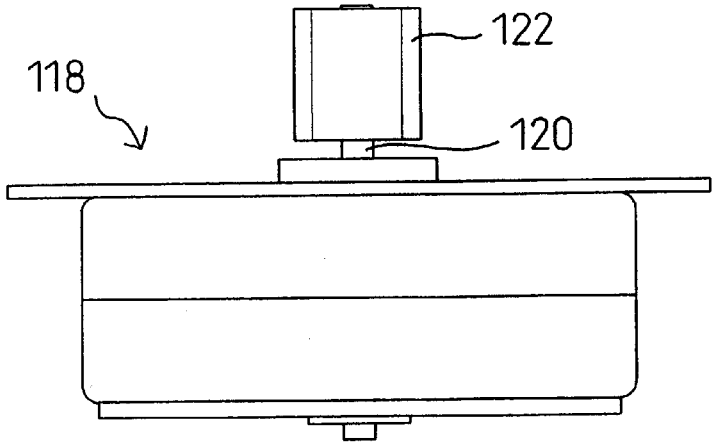

A passage of reciprocal movement of the first thread catching portion 100 extends sidewise slightly in the rear of the blade 86. A passage of reciprocal movement of the second thread catching portion 102 extends sidewise slightly in front of the blade 86. The first and second thread catching portions 100 and 102 assuming respective stand-by positions as shown in FIG. 24 are located on the left of a blade portion of the cutting blade 86 as shown in FIGS. 2 and 7. The thread catcher 92 is supported on the guide member 82 so that the first and second thread catching portions 100 and 102 are parallel to the cutting blade 86. The thread catcher 92 is formed by bending a metal plate, whereby the first and second thread catching portions 100 and 102 are integrally formed with a middle portion 104 being interposed therebetween. The first and second thread catching portions 100 and 102 are reciprocally moved together.

The first thread catching portion 100 has a stepped portion 106 formed integrally on a forward end with respect to the direction in which the thread catcher 92 is moved forward in its reciprocal movement, as shown in FIGS. 11A to 11F. A distal end 108 of the first thread catching portion 100 includes at least a lower portion formed by rightward extending a lower hook-shaped portion of the first thread catching portion 100. The lower portion of the distal end 108 is located lower than the hook-shaped portion. The distal end 108 includes an inclined portion inclined rightward upward so that the thread catcher 92 readily gets over the needle thread TD during the forward movement in the reciprocal movement thereof.

A cut thread holding member 112 is disposed in front of the guide hole 84 above the guide member 82, as shown in FIG. 3. The holding member 112 has a rearwardly extending feather 110. A thin metal plate 114 as shown in FIGS. 13A to 13C is disposed over the guide member 82 located to the left of the holding member 112. Both the holding member 112 and the thin plate 114 are screwed together so as to be located in front of the guide hole 84. The thin plate 114 includes a bent portion 116 formed in the rear portion thereof and inclined rightward downward. The bent portion 116 is located over the thread catcher 92 so as to downwardly thrust the thread catcher 92 by its elasticity as shown in FIG. 3.

Figure 4:
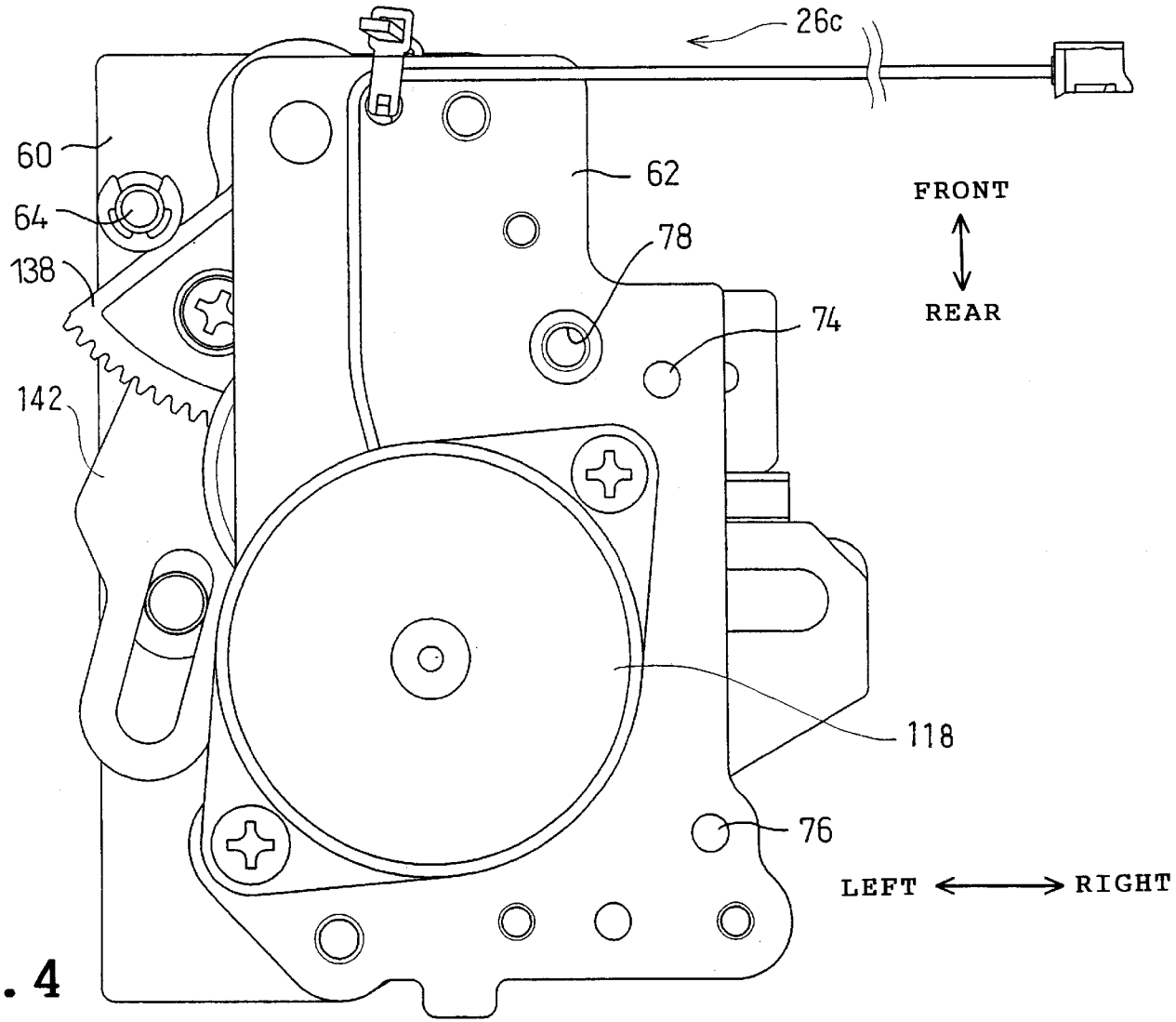
FIG. 4 is a bottom view of the thread cutting mechanism.
Figure 15A:
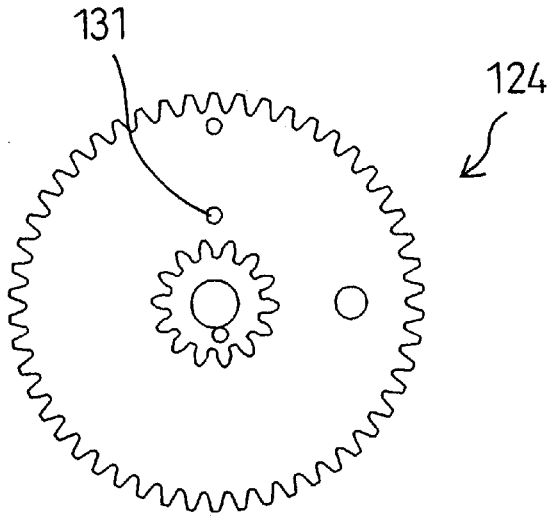
FIGS. 15A to 15C are plan, side and bottom views of an upper transmission gear respectively.
Figure 15B:
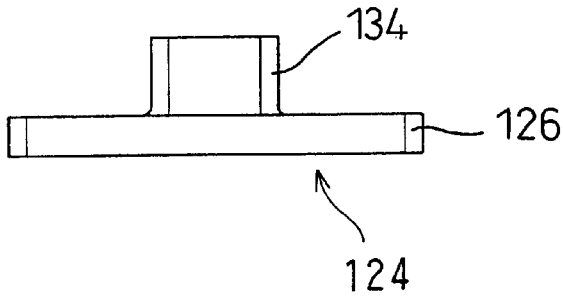
Figure 15C:
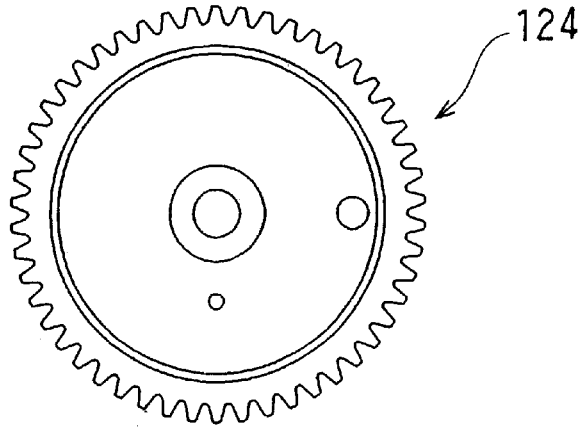
Figure 16A:
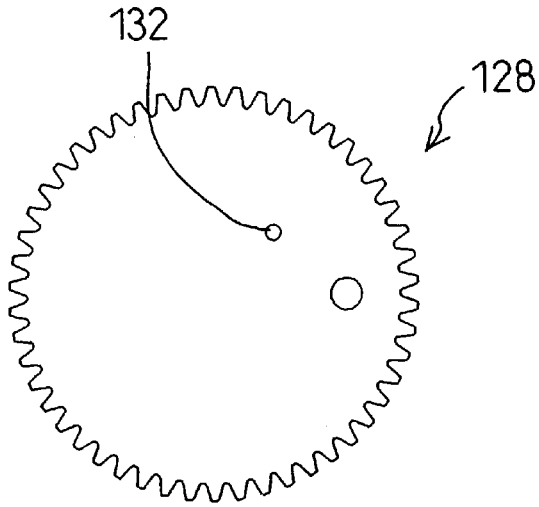
FIGS. 16A to 16C are plan, side and bottom views of a lower transmission gear respectively.
Figure 16B:
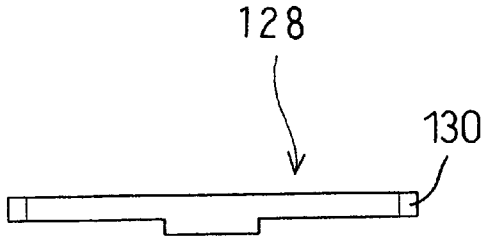
Figure 16C:
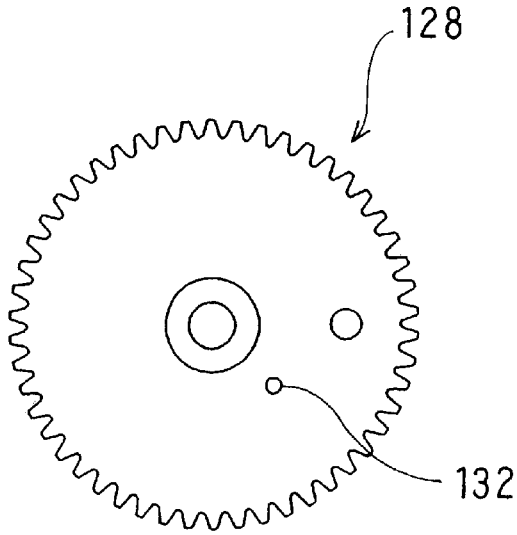

A thread cutting stepping motor 118 (see FIGS. 14A and 14B) is detachably mounted on the underside of the thread cutter base lower plate 62 of the thread cutting mechanism 26*c*, as shown in FIG. 4. The stepping motor 118 serves as another drive source independent of the machine motor 30. The stepping motor 118 includes a motor shaft 120 extending upward therefrom as shown in FIG. 5. A metal fixed gear 122 is fixed to the motor shaft 120. Both the shaft 120 and the fixed gear 122 are located between the aforesaid upper and lower plates 60 and 62. A resin upper transmission gear 124 includes a lower gear 126 as shown in FIGS. 15A to 15C. A resin lower transmission gear 128 includes a gear 130 as shown in FIGS. 16A to 16C. The lower gear 126 and the gear 130 are adapted to be brought into mesh engagement with the fixed gear 122 as shown in FIG. 5. The upper and lower transmission gears 124 and 128 are rotatably supported on a support pin 68 (see FIGS. 9A to 9F) upwardly protruding from the lower plate 62 as shown in FIG. 6.

The upper transmission gear 124 has a radially off-centered, vertically through connecting hole 131. A space is defined between the central portions of the upper and lower transmission gears 124 and 128. A generally C-shaped connecting member (not shown) is disposed in the space. The connecting member has an upwardly protruding first pin formed on one of two ends of the C-shape. The first pin is inserted into the connecting hole 131. The connecting member further has a downwardly protruding second pin formed on the other end of the C-shape. The lower transmission gear 128 has a radially off-centered vertically through connecting hole 132 into which the second pin is inserted. Accordingly, the upper and lower transmission gears 124 and 128 are rotated together upon drive of the thread cutting stepping motor 118. The connecting member is made from an elastic material so as to be able to flex radially for preventing backlash of the gears.

A resin thread cutting lever 136 includes a sectorial member 138 as shown in FIGS. 17A to 17F. The sectorial member 138 includes a rear sector gear 140. An upper gear section 134 of the upper transmission gear 124 is in mesh engagement with the sector gear 140 between the upper and lower plates 60 and 62 as shown in FIG. 6. An elongate pressing member 142 is screwed to the sectorial member 138 so as to be located over the latter. The lower plate 62 has an upwardly protruding front support pin 66 as shown in FIGS. 9A to 9E. The sectorial member 138 includes a front cylindrical portion 144 into which the support pin 66 is fitted as shown in FIG. 6. Accordingly, the sectorial member 138 and the pressing member 142 are swung together upon rotation of the upper transmission gear 124. The pressing member 142 has an elongate pressing through hole 146 formed in the rear end thereof as shown in FIG. 17A. The lower portion of the guided portion 94 extends through the hole 146 as shown in FIG. 7.

The thread cutting mechanism is constructed as described above with reference to FIGS. 2 to 7. When the stepping motor 118 is energized to be rotated clockwise as viewed over the machine, the thread cutting lever 136 is operated so that a vertical inner wall of a left-hand side 147 of the pressing hole 146 presses a lower portion of the left-hand guided portion 94 of the thread catcher 92 rightward (forward movement in the reciprocal movement). On the other hand, when the stepping motor 118 is energized to be rotated counterclockwise as viewed over the machine, the thread cutting lever 136 is operated so that a vertical inner wall of a right-hand side 148 of the pressing hole 146 presses a lower portion of the left-hand guided portion 94 leftward (return movement in the reciprocal movement).

Figure 18:
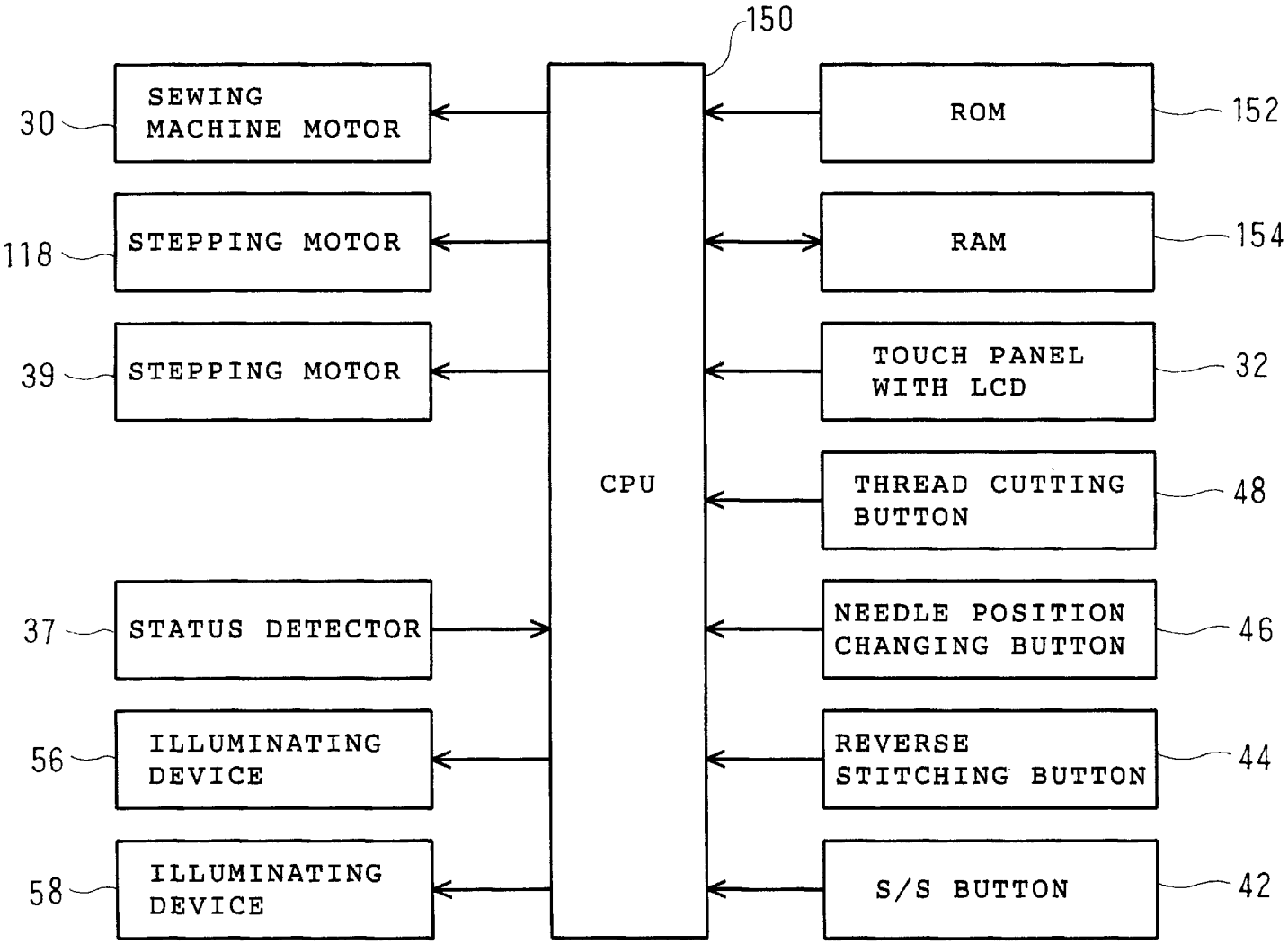
FIG. 18 is a flowchart showing a thread-cutting control.
Figure 19:
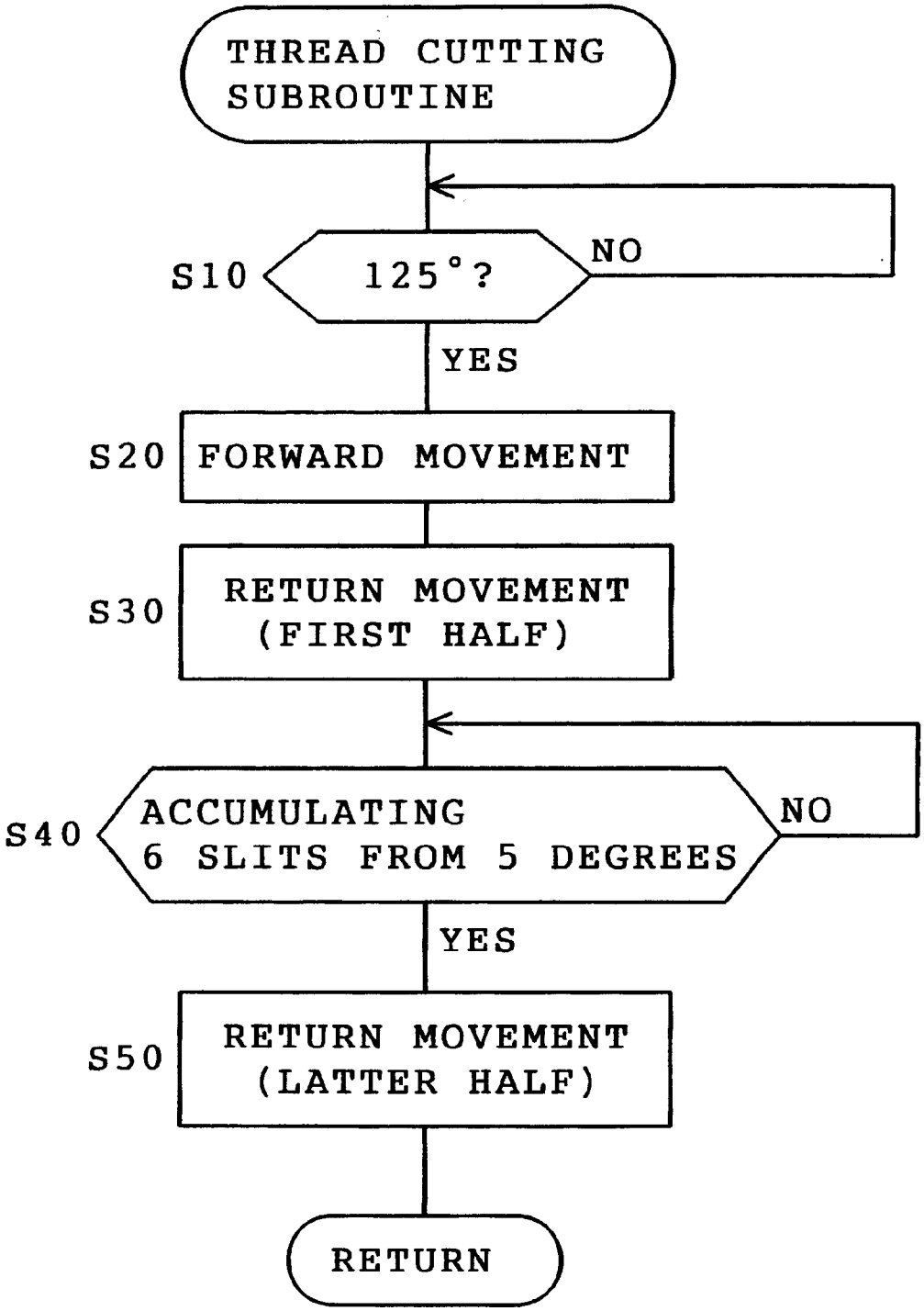
FIG. 19 is a block diagram showing an electrical arrangement of the sewing machine.
Figure 20:
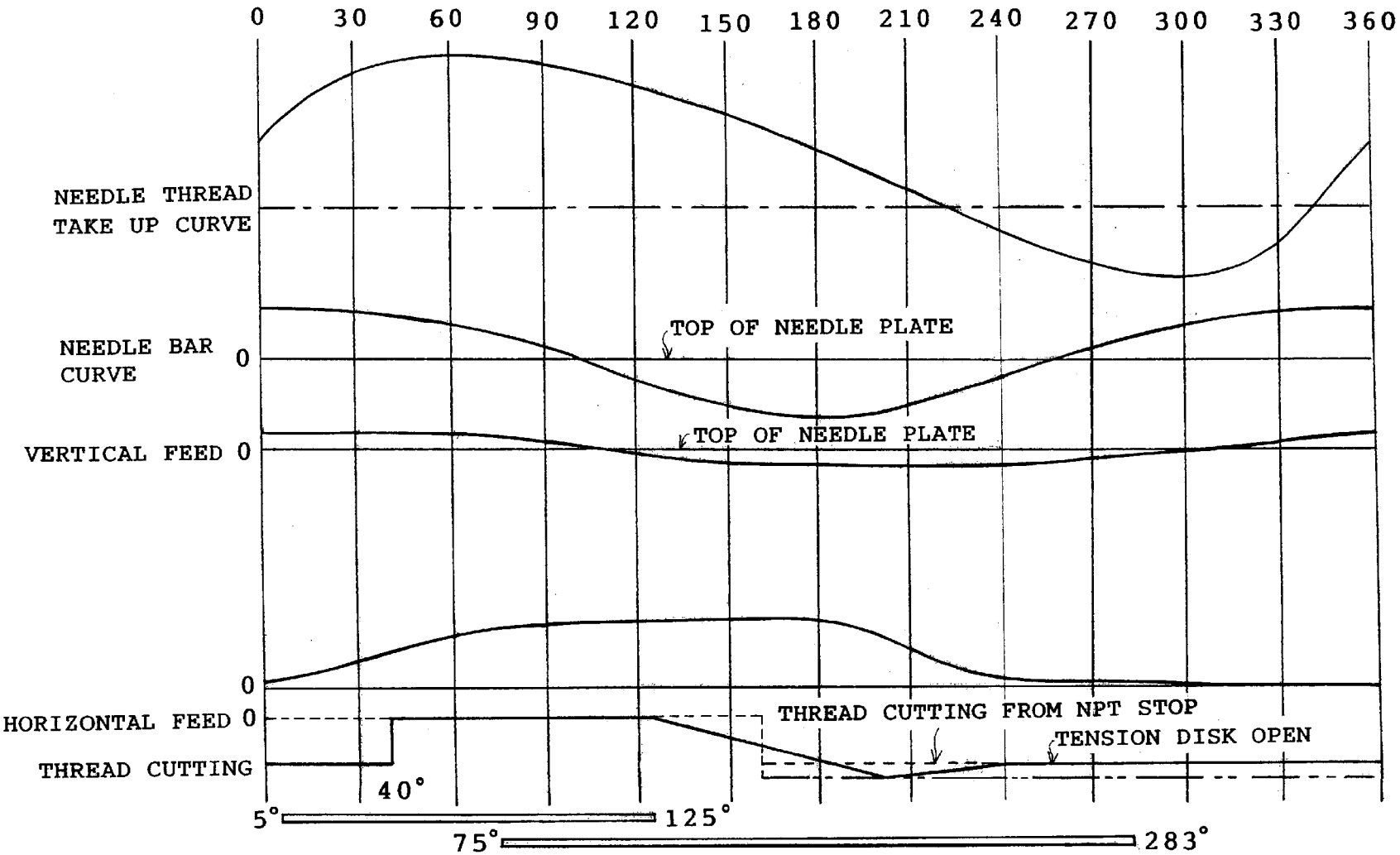
FIG. 20 is a timing chart showing an operation of the sewing machine.
Figure 21:
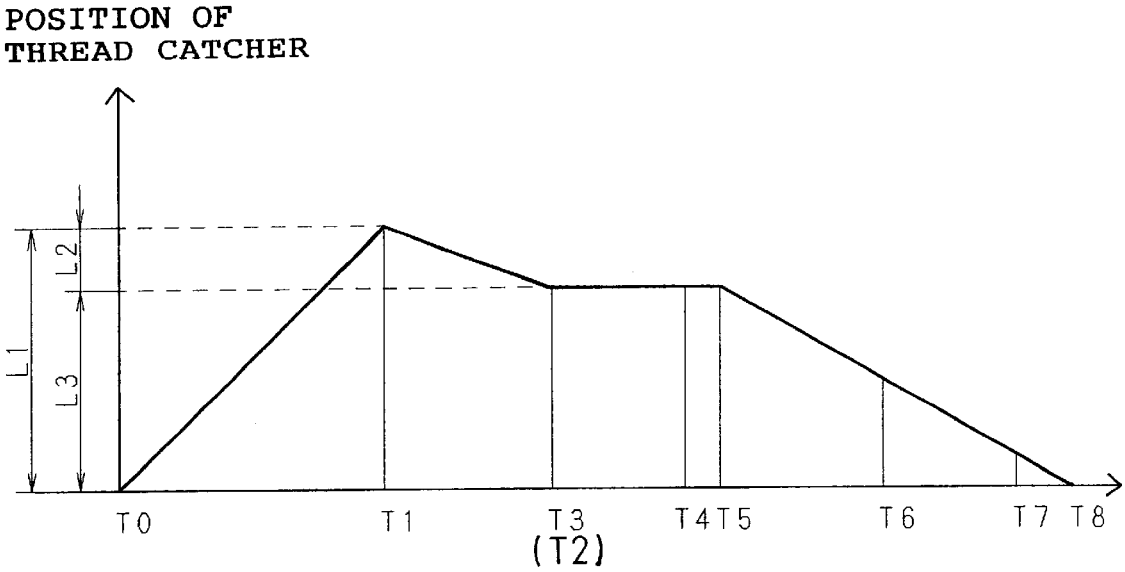
FIG. 21 is a graph showing the relationship between the location of the thread catcher and lapse of time.

FIG. 18 illustrates an electrical arrangement of the sewing machine 10. The sewing machine 10 includes a CPU 150 to which the above-described means are connected. A ROM 152 and a LAM 154 are further connected to the CPU 150. The CPU 150 controls the sewing machine motor 30, the thread cutting stepping motor 118 and the like on the basis of a control program stored by the ROM 152 and control data. The LAM 154 is used by the CPU 152 during the aforesaid control. The control program stored by the ROM 152 is shown in FIG. 19. According to the control program, in the thread cutting, a needle thread take-up P, a needle bar NB, the feed dog 25 and the thread cutting mechanism 26*c* are operated when the main shaft 36 assumes every angle. Furthermore, the thread catcher 92, the needle thread TU, the bobbin thread TD and the loop seizing beak 27 are in such positional relations as shown in FIGS. 24 to 33.

A control manner for the thread cutting operation carried out by the sewing machine 10 will now be described. The aforesaid control program is executed in the procedure as shown in FIG. 19. The CPU 150 detects the timing for start of reciprocal movement of the thread catcher 92 on the basis of a shutter portion (a part of the status detector 37) which indicates that the rotational angle of the main shaft 36 is 125 degrees (step S10). The thread catcher 92 is then moved forward from a left-hand stand-by position by distance L1 (step S20; forward movement in the reciprocal movement). Upon completion of the forward movement, the thread cutting stepping motor 118 is controlled so as to be rotated in the direction opposed to that in the forward movement so that the thread catcher 92 is returned by a distance L2 (step S30). As a result, the thread catcher 92 is returned to the middle of the return passage and then stopped. The CPU 150 controls the sewing machine motor 30 during stop of the thread catcher 92. Furthermore, based on the accumulated number of slit signals from a speed shutter of the main shaft 36, the CPU 150 detects the timing for rightward movement of the needle thread TU to the thread catcher 92 by the beak 27, so that thread cutting is completed immediately before the main shaft reaches 40 degrees and stops (step S40). The aforesaid speed shutter is a part of the status detector 37 and 80 slits are counted for one turn of the speed shutter. Upon detection of the timing, the CPU 150 restarts the return movement of the thread catcher 92, so that the thread catcher is returned by a distance L3 through the thread cutting position to the stand-by position (S50).

FIG. 19 is a flowchart showing the control of the thread cutting stepping motor 118. Other mechanisms are controlled on the basis of respective other programs. For example, the sewing machine motor 30 is controlled by a known interrupt handling on the basis of another program. Regarding the standby period of the thread catcher 92 or a period between times T3 and T5, too, the thread cutting stepping motor 118 is controlled by the CPU 150. Regarding the position of the thread catcher 92 in operation, the rotational position of the motor shaft 20 of the stepping motor 118 or the position of the thread catcher 92 need not be detected using a sensor. As a general characteristic of a stepping motor, an inverse calculation can achieve the number of drive pulses required to obtain a position of the thread catcher 92 on the basis of the rotational speed of the motor shaft 120. Accordingly, an open loop control is employed for the stepping motor 118. For example, in the period from start of forward movement of the thread catcher 92 to the intermediate stop, a previously determined number of pulses is continuously supplied to the stepping motor 118 without detection of the position of the thread catcher 92 by a detector. The number of drive pulses is previously determined by data based on a distance of forward movement and a distance of halfway return movement in the reciprocal movement.

Figure 22:
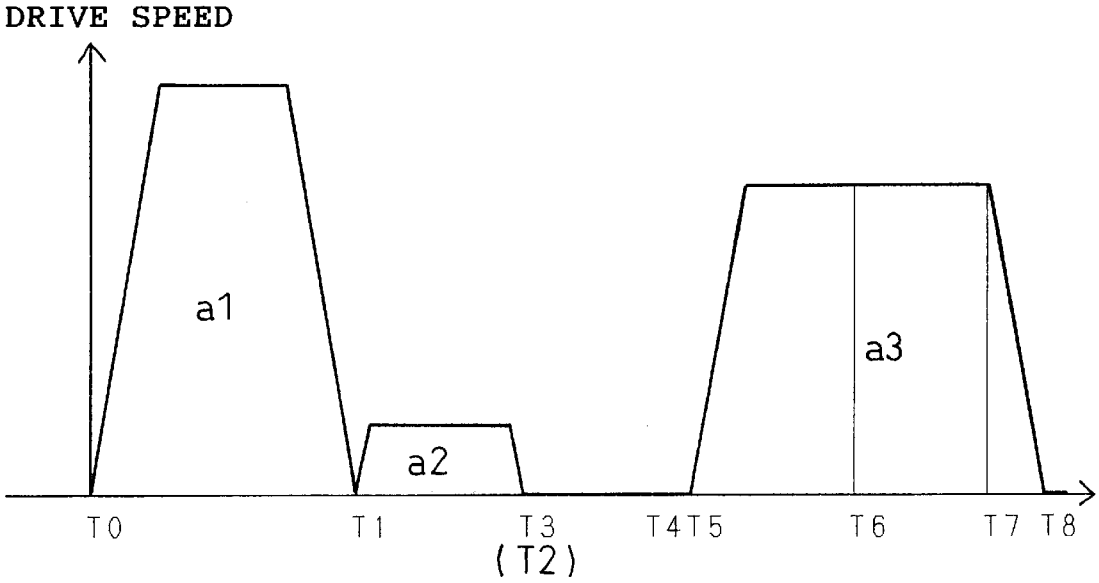
FIG. 22 is a graph showing the relationship between a driving speed for the thread catcher and lapse of time.

The number of pulses is gradually increased during start of rotation of the stepping motor 118, whereas the number of pulses is gradually reduced during stop of rotation of the stepping motor 118. FIG. 22 is a graph showing the relationship between a driving speed per unit time (axis of ordinates) and lapse of time (axis of abscissas). The graph is represented as trapezoids whose areas are in direct proportion to distances of movement. Since the distance of forward movement is equal to the distance of return movement in the reciprocal movement, the relationship among the trapezoidal areas a1, a2 and a3 is represented as:

$$a1=a2+a3.$$

Figure 23:
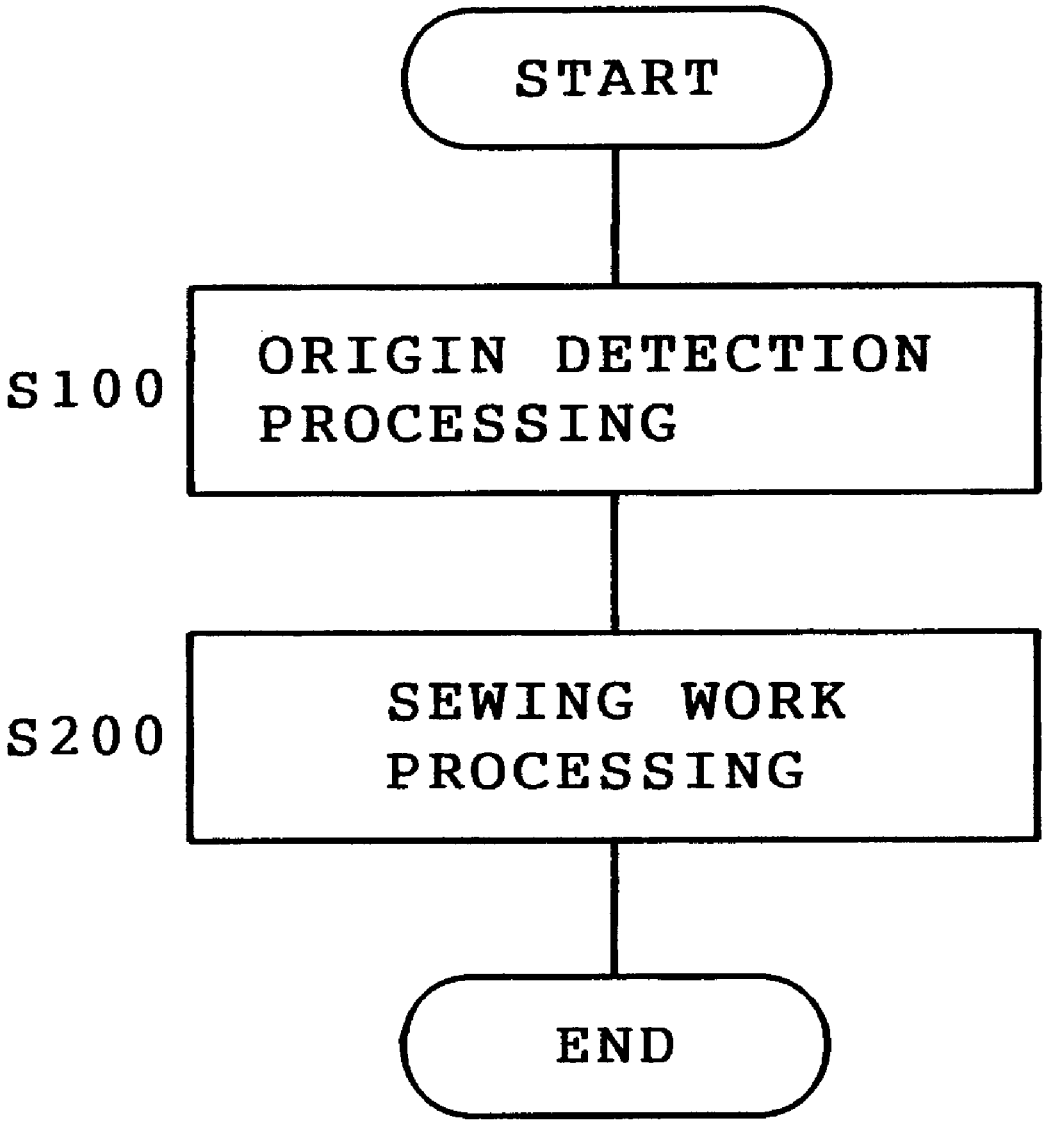
FIG. 23 is a flowchart showing a control manner upon power supply to the sewing machine.

For the purpose of open loop control, the stepping motor 118 is controlled so that the left-hand flat vertical end face of the sector gear 140 is sufficiently pressed against a side hard rubber 65 of an origin detecting pin 64 upon power supply to the sewing machine 10. Consequently, the stepping motor 118 is automatically set to the origin. As shown in FIG. 23, usual processing (S200) for the sewing operation such as pattern selection is carried out after the processing for origin detection (S100).

In the above-described sewing machine, the control of the stepping motor 118 is started at time TO so that the thread catcher 92 is moved forward in the reciprocal movement. Furthermore, the control of the stepping motor 118 or pulse accumulation is started at time T5 so that the thread catcher 92 is returned in the reciprocal movement. The times T0 and T5 are determined on the basis of the signals delivered from the main shaft 36. In general, household sewing machines cannot employ a complicated control manner and construction both of which increase the costs. Accordingly, there is a possibility that an external load may cause run-out of the sewing machine motor 30.

According to the foregoing control program, however, even when an external load causes run-out of the sewing machine motor 30 between times T0 and T5 or the rotational speed of motor is not as controlled, the motors 118 and 30 are controlled to be synchronized with each other so that both motors are controlled on the basis of a rotational angle of the main shaft 36 at each of times T0 and T5. Consequently, the needle N, beak 27, feed dog 25 and thread catcher 92 are usually in a predetermined positional relation for the thread cutting at least each of times T0 and T5.

Drive data for the stepping motor 118 is determined so that the thread catcher 92 has such a predetermined relation with rotation of the beak 27 that the thread can be caught by the thread catcher. Furthermore, the main shaft is stopped at 40 degrees in order that the needle thread take-up P may be stopped at a location where the thread can easily be guarded. The value of 40 degrees is a target value, and the main shaft 36 is actually deviated to some extent. More specifically, the usual sewing machine motor requires 5 to 10 degree rotation of the main shaft until the brake is effected such the motor is stopped. Thus, unless a high-performance motor with high responsibility is used, the thread cutting is completed while the beak of the horizontally rotating shuttle is in rotation.

The above-described control manner is directed to starting the sewing machine motor assuming the needle up stop for thread cutting. However, the thread may be cut in a period continuous from the sewing operation (or when the sewing has been finished) without stopping the motor 30. In this case, the motor 30 is controlled so that a rotational speed thereof is reduced from a set sewing speed (for example, 200 rpm) to a first predetermined low speed (88 rpm) and further to a second predetermined low speed (70 rpm). When the main shaft 36 reaches the rotational angle of 125°, the thread cutting motor 118 is controlled on the basis of two angles 125° and 40° in the same manner as described above while the sewing machine motor 33 is in rotation, whereby the thread cutting is carried out. In this period, too, the actual rotational speed of the motor 30 does not always correspond to the controlled speed and is fluctuating by several rpm, and yet, the thread cutting can be carried out. More specifically, the drive data for the stepping motor 118 is originated in consideration of a rotational locus of the beak 27 etc. so that even when the rotational speed of the motor 30 or the beak 27 of the horizontally rotating shuttle) is changing during the thread cutting, the thread catcher 92 reaches the location where the needle thread TU can be caught.

In order that the thread may be cut in the period continuous from the sewing operation as described above, the user previously operates an automatic thread cutting button on a transparent touch panel 32 with LCD to set an automatic thread cutting mode. Consequently, the above-described thread cutting is automatically carried out when the S/S operation button 42 is depressed for termination of the sewing during the sewing. Thus, the user can devote himself or herself to the sewing.

Figure 34:
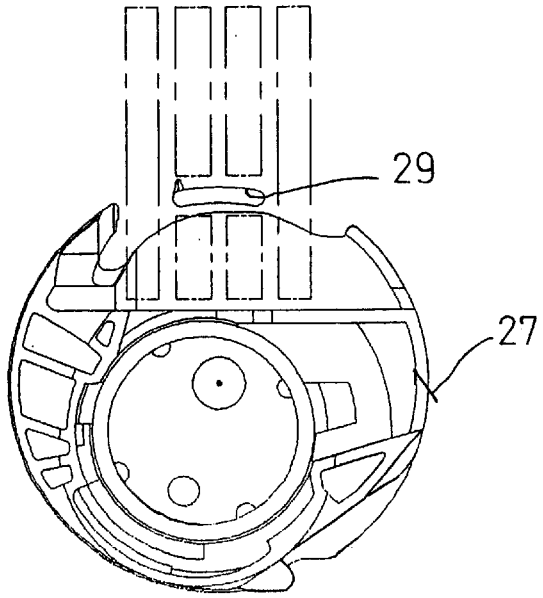
FIG. 34 shows the beak of the horizontal shuttle when the shuttle assumes a position below the needle.

The beak 27 of the horizontally rotating shuttle assumes the position as shown in FIG. 34 before start of thread cutting when the thread cutting is started with the needle being located at a lower stop position. When the user depresses the thread cutting button 48 with his or her finger while the needle is located at the lower stop position, a thread cutting command is generated and the stepping motor 118 is controlled so that the forward movement and the first half of the return movement of the thread catcher 92 are carried out under the condition where the needle is located at the lower stop position. In this case, the sewing machine motor 30 which is stopped is controlled to be rotated at 70 rpm. An external load may cause run-out of the motor 30 in a period from when the need is located at the lower stop position to the completion of thread cutting (rotational angle of the main shaft is 275°). A thread cutting program and data used when the needle is located at the lower stop position differs from those used when the thread is cut in the period continuous from the sewing period. In other words, an internal storage device stores a plurality of programs and data according to a plurality of conditions of the sewing machine.

The thread cutting is carried out without formation of a predetermined speed range for the thread cutting in the motor 30 when the thread cutting is carried out while the needle is located at a predetermined upper stop position, while the motor speed is being reduced, and while the needle is located at the lower stop position.

The thread catcher 92 is forward moved and returned by distance L2 in order that the bobbin thread TD may be prevented from being caught by an unexpected portion of the thread catcher 92, for example, a right-hand distal end thereof. Furthermore, the thread catcher 92 is stopped during the return movement thereof (times T3 to T5), whereby the motor 118 is re-synchronized with the main shaft 36 (the beak 27 etc.). If start of the return movement of the thread catcher 92 should be advanced and the thread should be cut, the needle thread would fall out of the needle N when the thread is pulled up by the needle thread take-up P.

Figure 26:
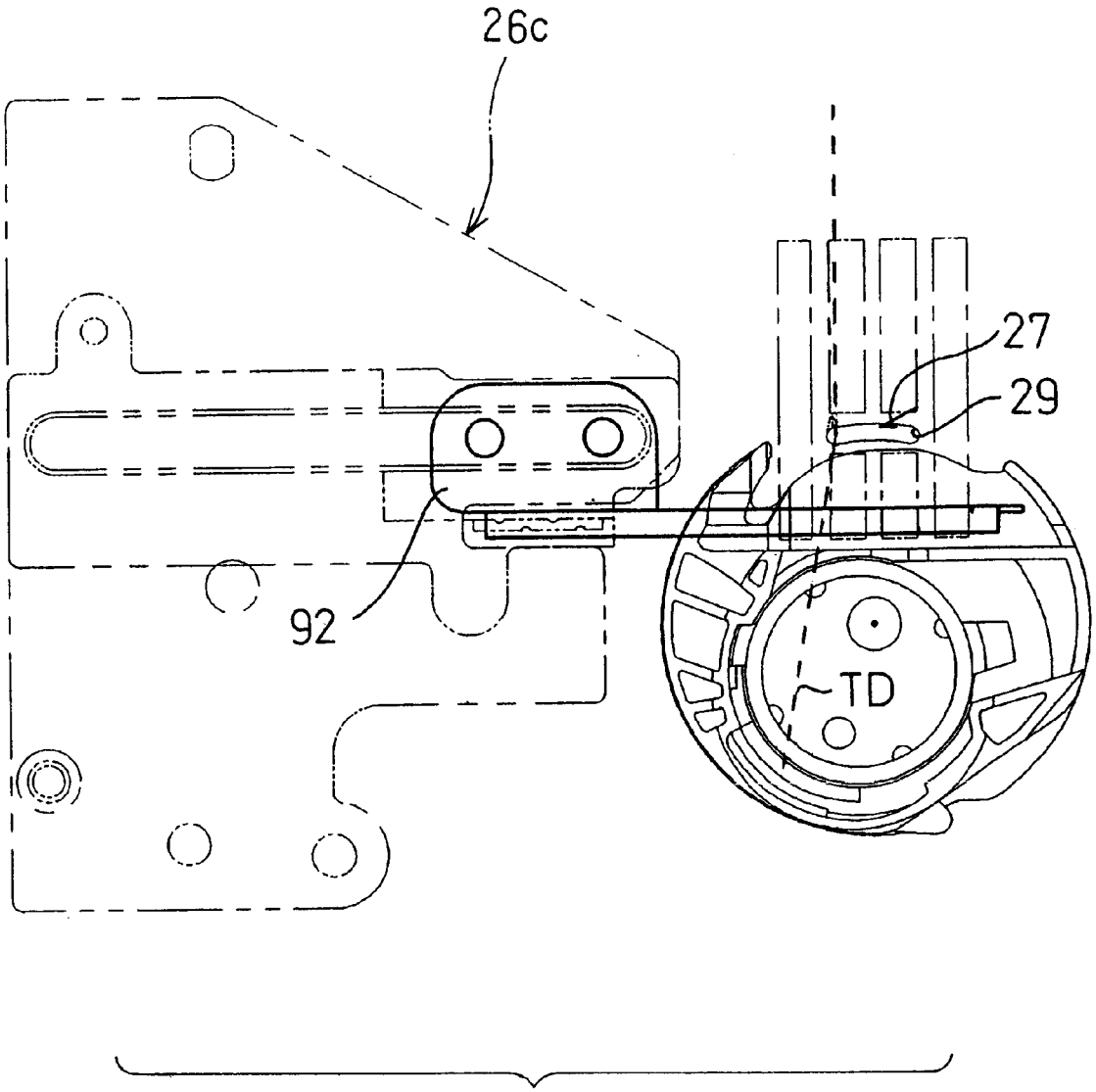
FIG. 26 is a plan view of the thread cutting mechanism in the case where the thread cutter assumes a turning point of the reciprocal movement.
Figure 27:
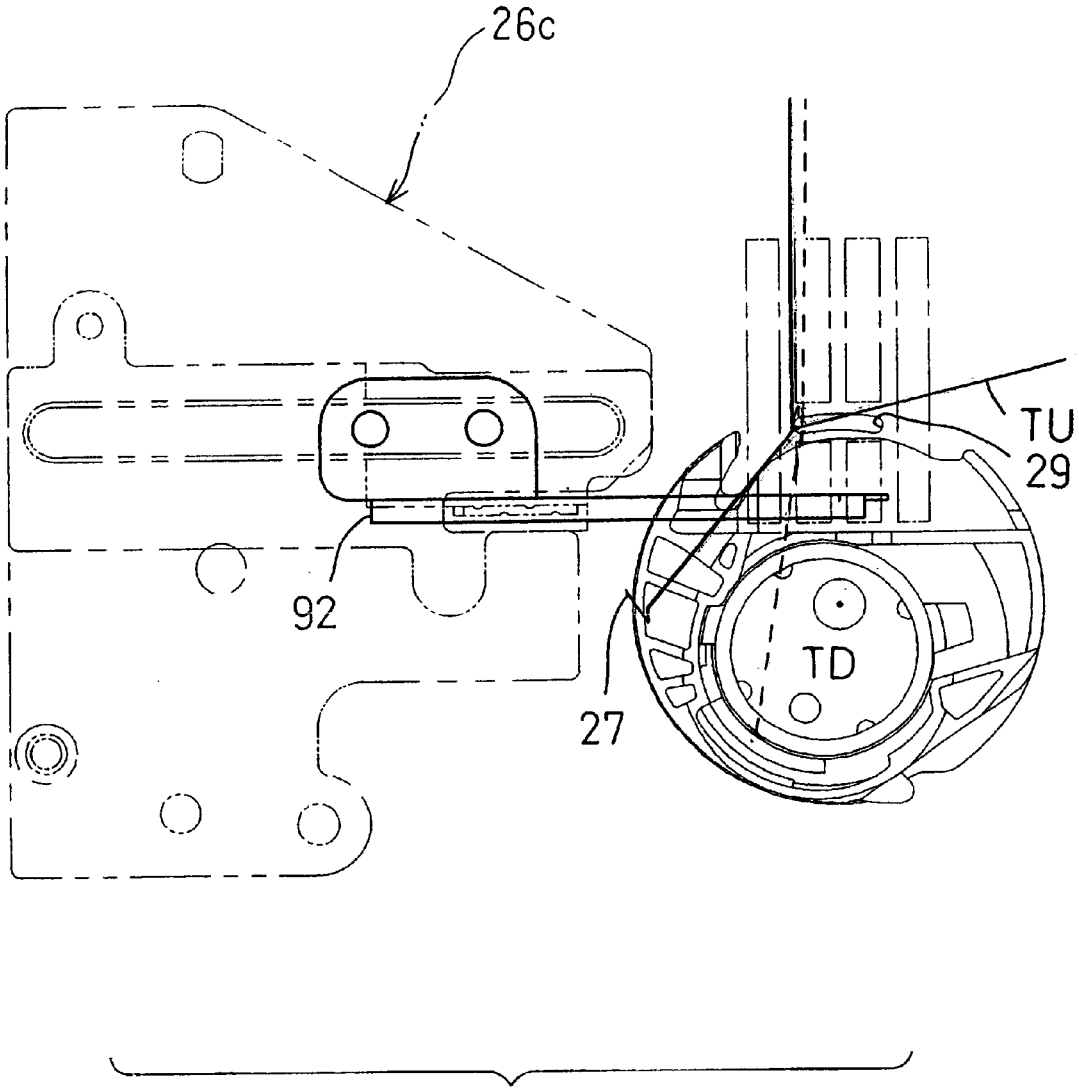
FIG. 27 is a plan view of the thread cutting mechanism in the case where the thread catcher is stopped in the midst of the backward movement.
Figure 28:
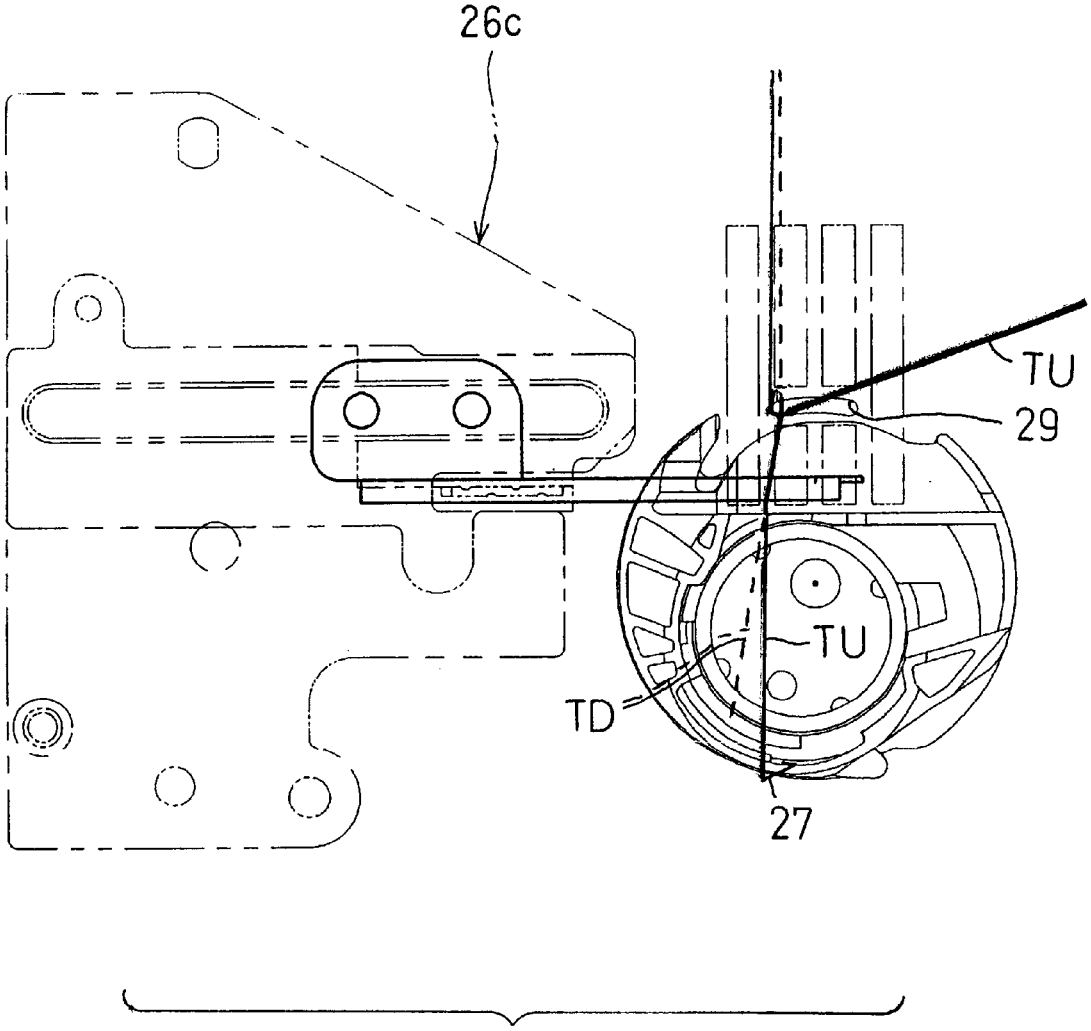
FIG. 28 is a plan view of the thread cutting mechanism in the case where the thread catcher has caught the needle thread.
Figure 35:
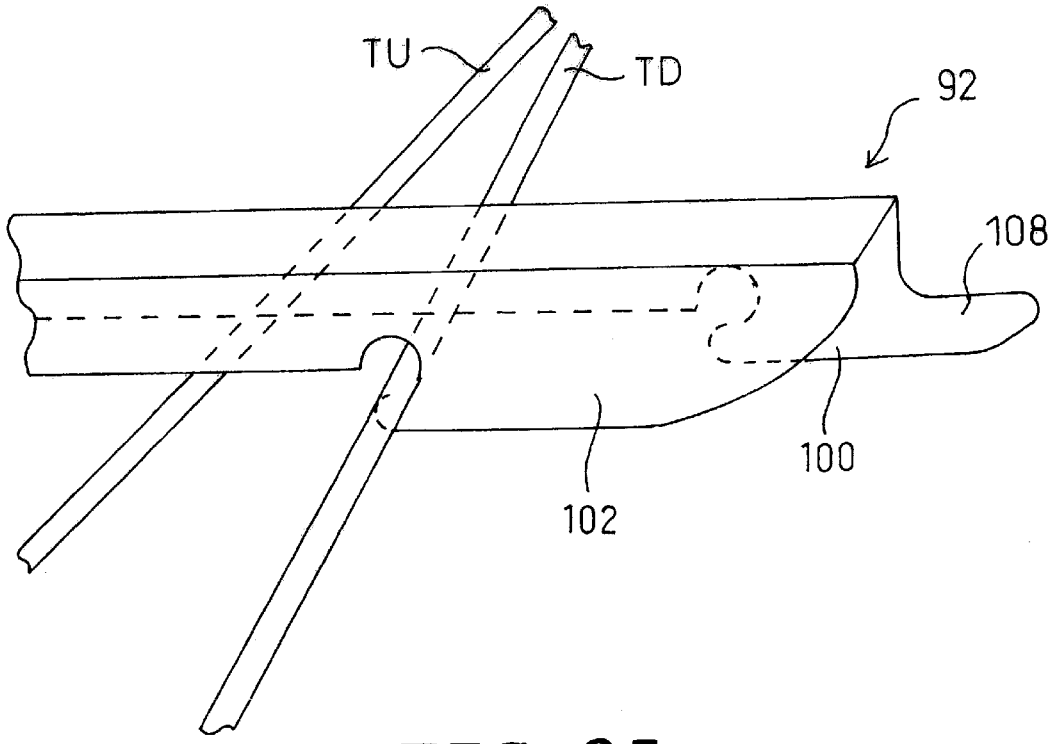
FIG. 35 is an enlarged view of the thread catcher in the state as shown in FIG. 27.
Figure 36:
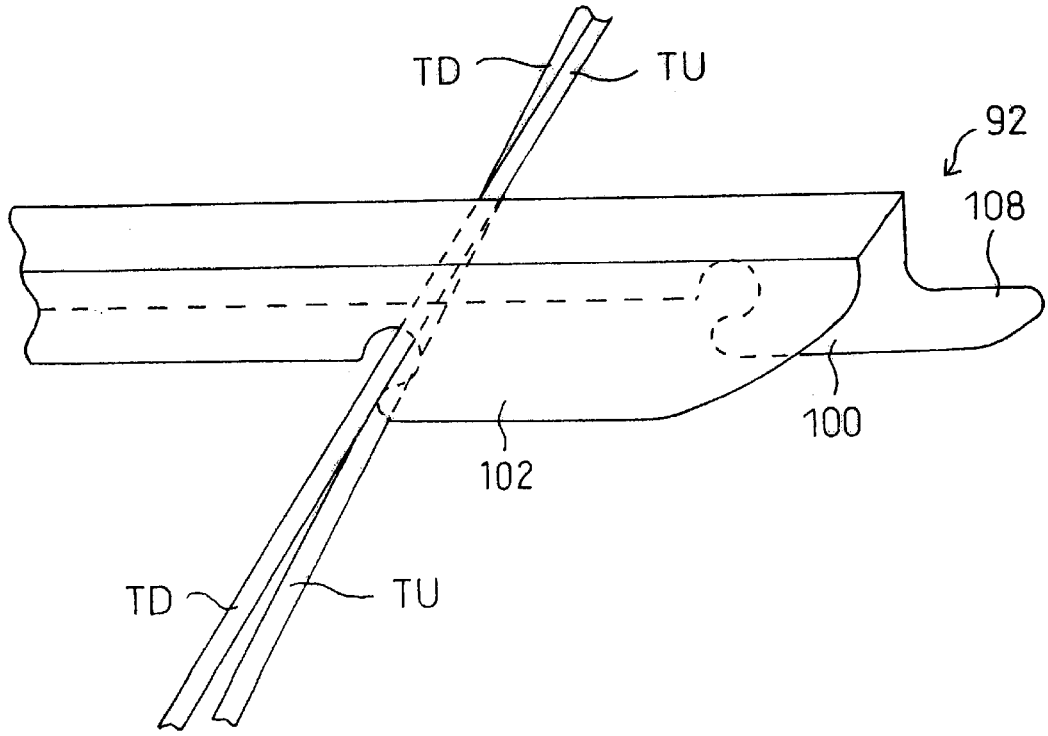
FIG. 36 is an enlarged view of the thread catcher in the state as shown in FIG. 28.

The conditions of the thread and the thread catcher 92 during the thread cutting will now be described. The thread catcher 92 is on standby at the left-hand standby position (FIG. 24) and is forward moved rightward when the timing for the foregoing start of return movement is reached (T0). The thread catcher 92 is then caused to get over the bobbin thread TD (FIG. 25) and moved by distance L1. The thread catcher 92 further passes over the bobbin thread TD, reaching the return position (FIG. 26, T1). The needle thread has not been caught by the beak 27 yet although the needle N is located below the needle plate 28 on the right of the bobbin thread TD. The thread catcher 92 is returned by distance L2 continuously from the forward movement and stopped over the central portion of the horizontally rotating shuttle (FIGS. 27 and 35, T3) after the bobbin thread TD has been caught by the second thread catching portion 102 (T2). The needle thread TU is caught by the beak 27 of the shuttle during the return movement by distance L2. However, the needle thread TU has not reached the second thread catching portion 102 even after completion of the return movement of the thread catcher 92 by distance L2. When the beak 27 is rotated counterclockwise as viewed from above it, a part of the needle thread TU located over the horizontally rotating shuttle is moved rightward by the beak 27 of the shuttle, whereupon the needle thread TU is also caught by the second thread catching portion 102 (FIGS. 28 and 36, T4).

The needle thread TU and bobbin thread TD are moved leftward only by the second thread catching portion 102 when the thread catcher 92 is returned leftward again immediately before stop of the motor 30 which is continuously in rotation during the thread cutting operation (T5). Since the right-hand end 108 is the lowest in the right side of the thread catcher 92, the needle thread TU at the needle side is prevented from getting under the thread catcher 92.

Figure 29:
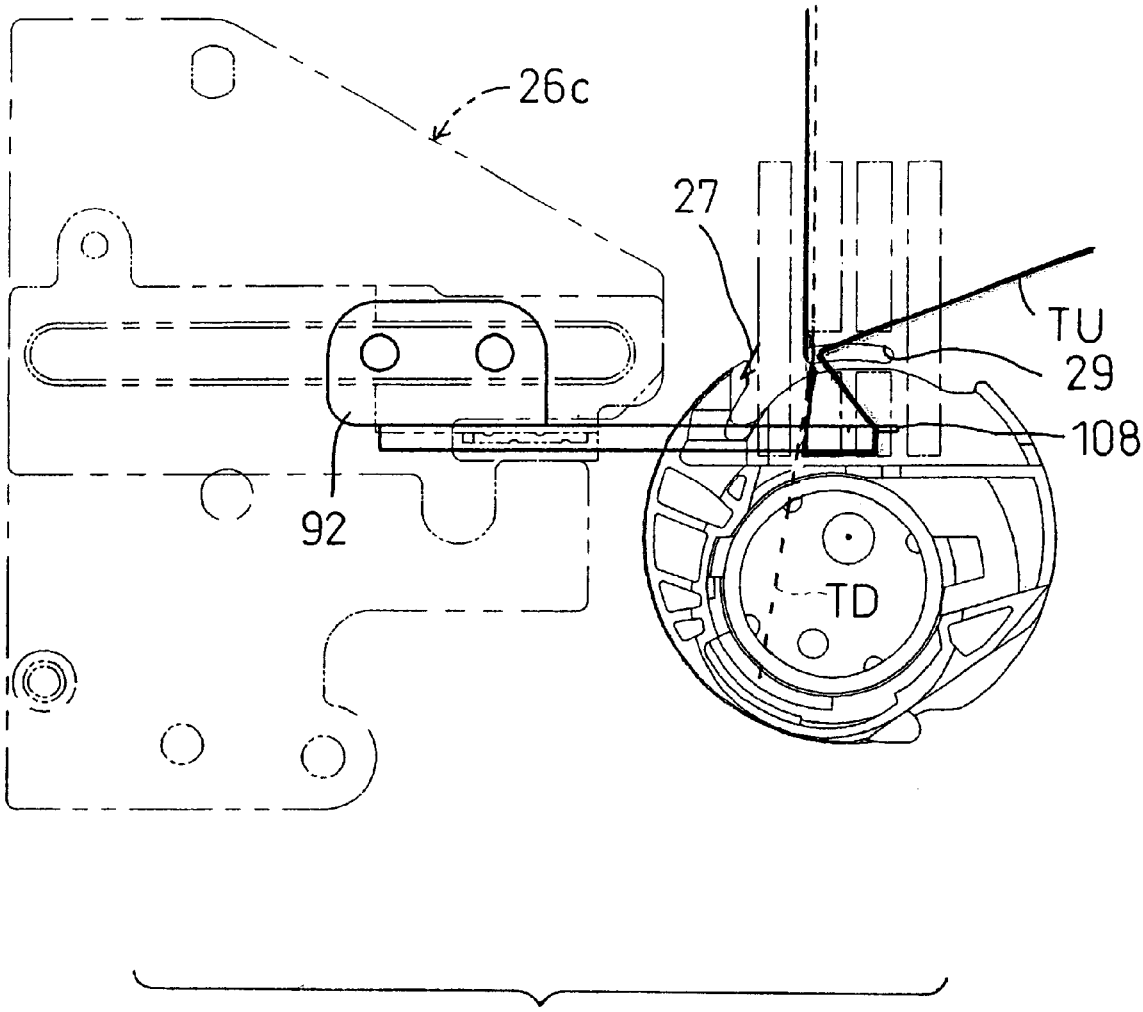
FIG. 29 is a plan view of the thread cutting mechanism in the case where the needle thread has wound on the front of the thread catcher.
Figure 37:
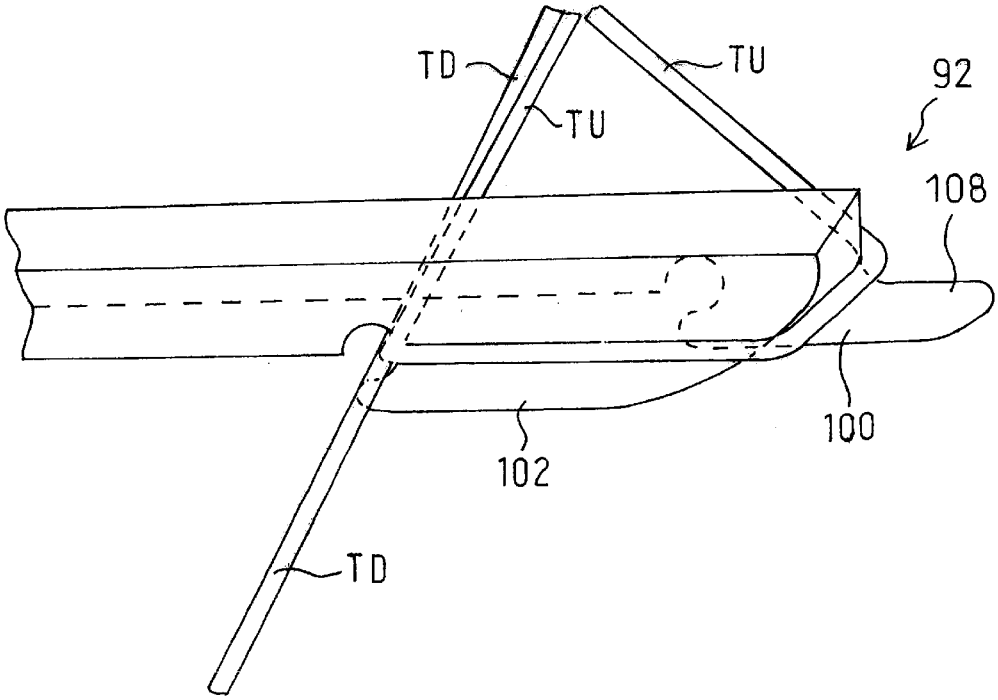
FIG. 37 is an enlarged view of the thread catcher in the state as shown in FIG. 29.

The needle thread TU is wound onto the front of the thread catcher 102 when the thread catcher 92 is slightly moved leftward. A portion of the needle thread TU located nearer to the needle side than the wound portion is located just on the right of the stepped portion 106 of the first thread catching portion and over the right-hand end 108 (FIGS. 29 and 37). The stepped portion 106 is low. Accordingly, even when the second thread catching portion 102 is provided with a portion for preventing getting under the thread catcher 92 (the right-hand end 108), a path is ensured for the needle thread TU wound on the first thread catching portion 102 to go into the needle hole 29.

Furthermore, middle needle thread TU and bobbin thread TD are located between the portion of the thread caught by the thread catcher 92 and the needle hole 29. The middle needle thread TU and bobbin thread TD passes through the through-hole of the feed dog 25 from the rear to the front with a forwardly downward inclination. Furthermore, the middle needle thread TU and bobbin thread TD located nearer to the cloth side than the thread catcher 92 is located along the cutout 25*b* of the underside front end of the feed dog 25. At an initial stage of the thread cutting, on the front of the left side 25*c* of the cutout 25*b* (the front of the feed dog 25) are not wound the needle thread TU and bobbin thread TD located nearer to the cloth side than the thread catcher 92 and the needle thread TU at the needle side (see FIG. 41).

Figure 30:
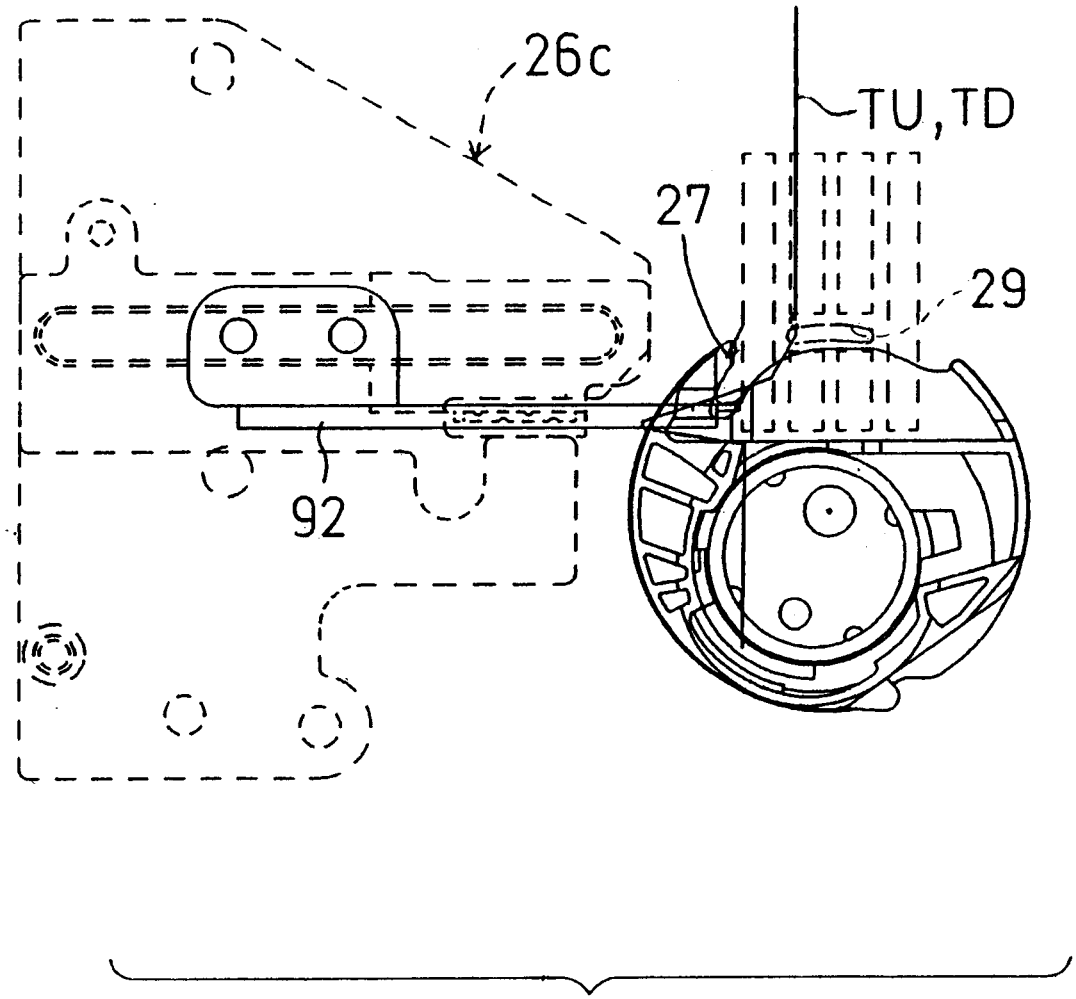
FIG. 30 is a plan view of the thread cutting mechanism in the case where the first thread catching portion of the thread catcher has caught the thread.
Figure 31:
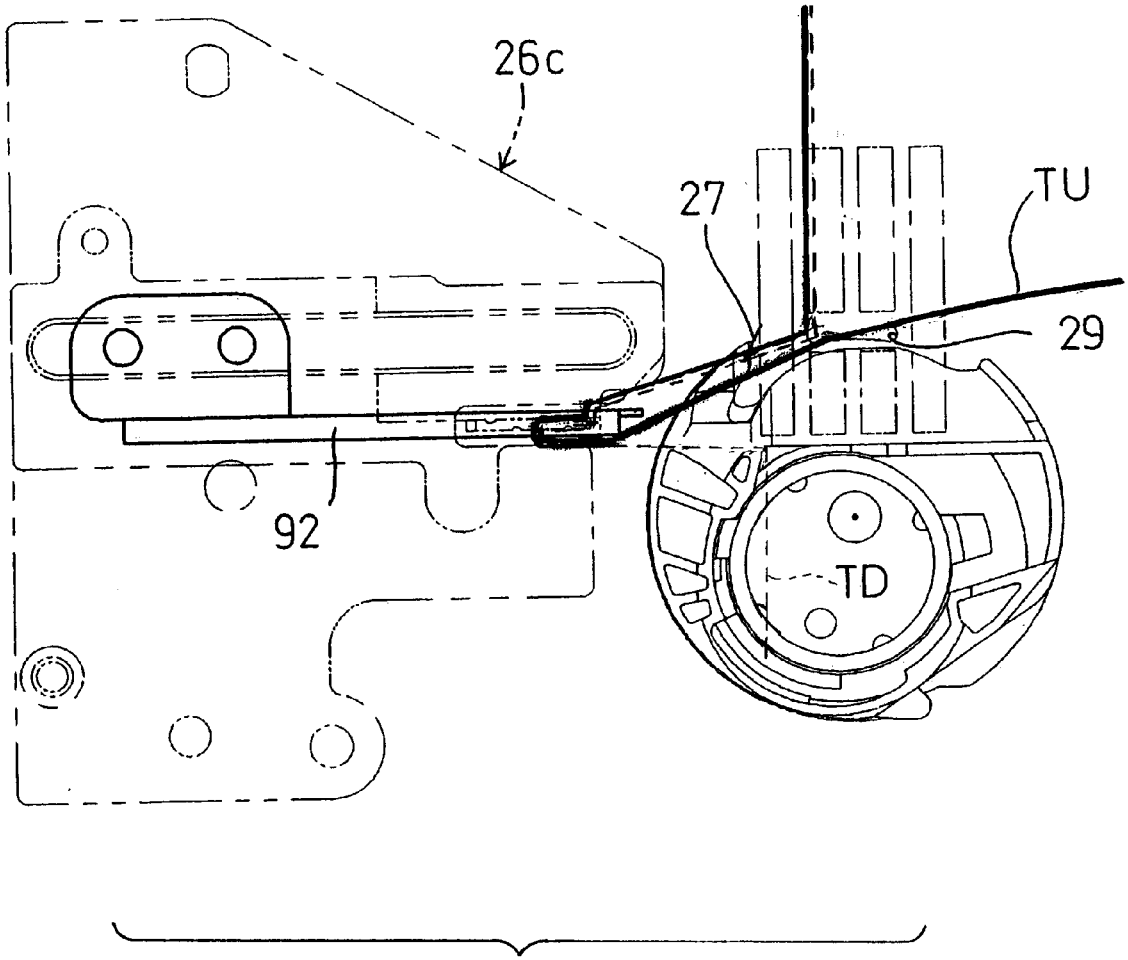
FIG. 31 is a plan view of the thread cutting mechanism immediately before cutting the thread.
Figure 32:
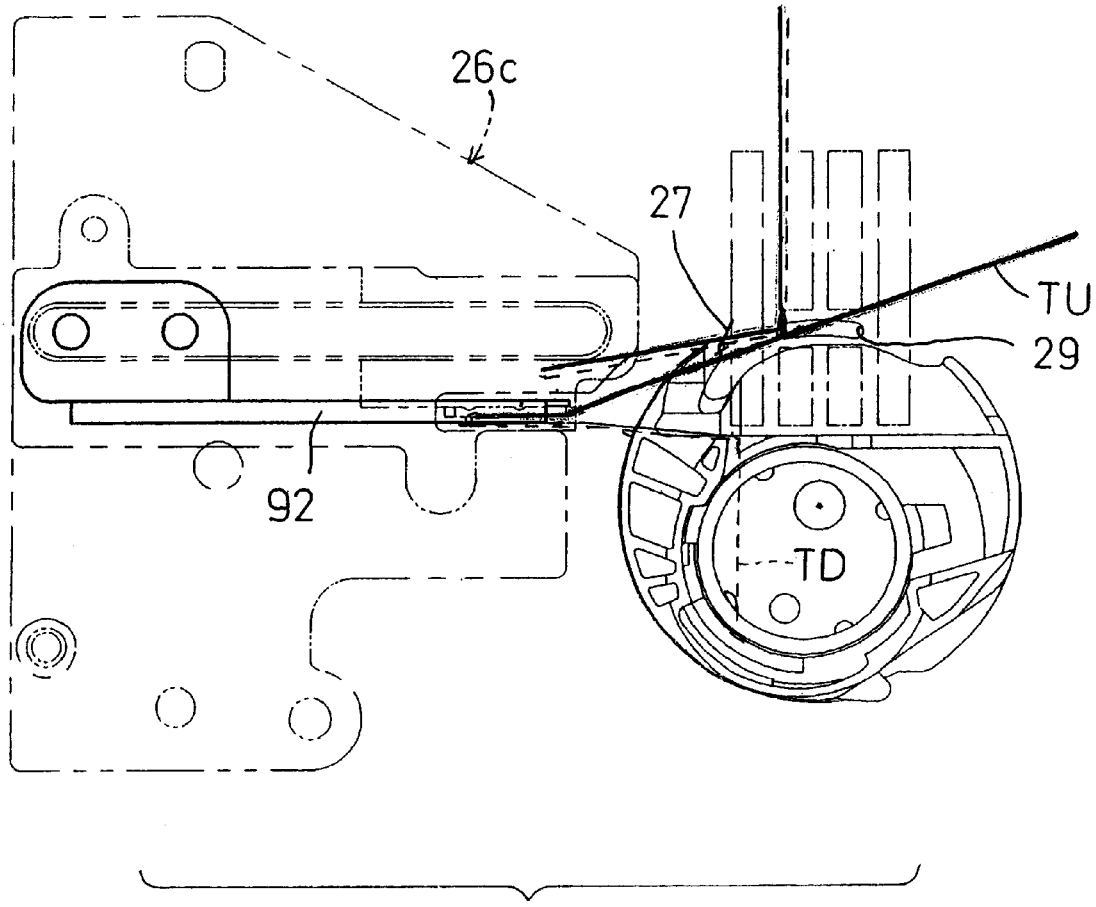
FIG. 32 is a plan view of the thread cutting mechanism with the thread catcher assuming the standby position after the thread cutting.
Figure 33:
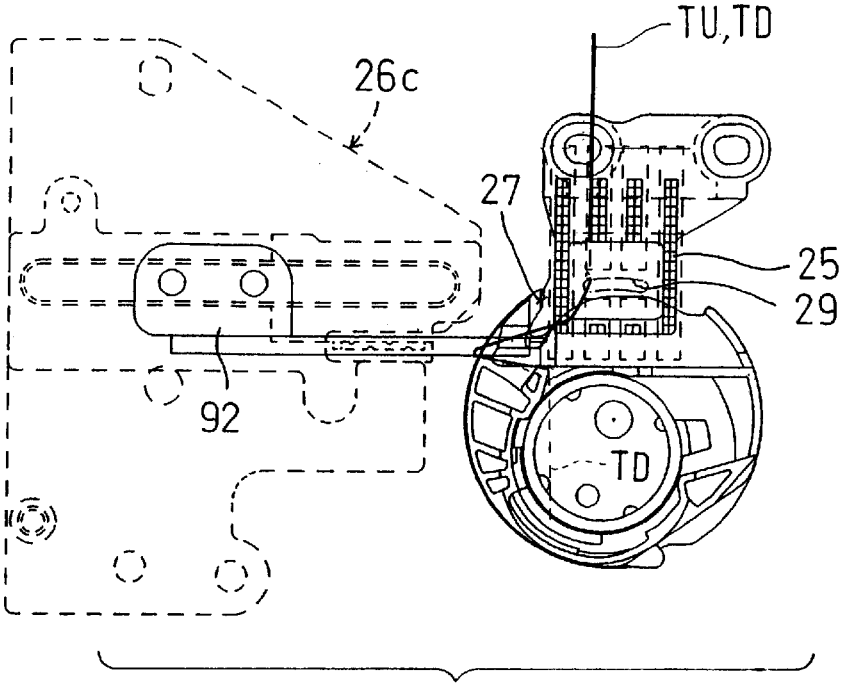
FIG. 33 is a view similar to FIG. 30, further showing a feed dog.
Figure 38:
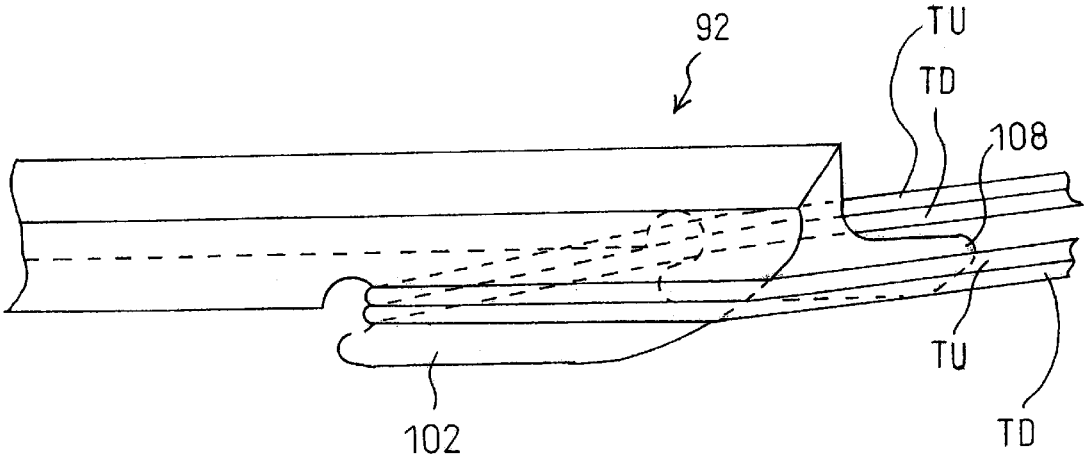
FIG. 38 is an enlarged view of the thread catcher in the state as shown in FIG. 30.
Figure 39:
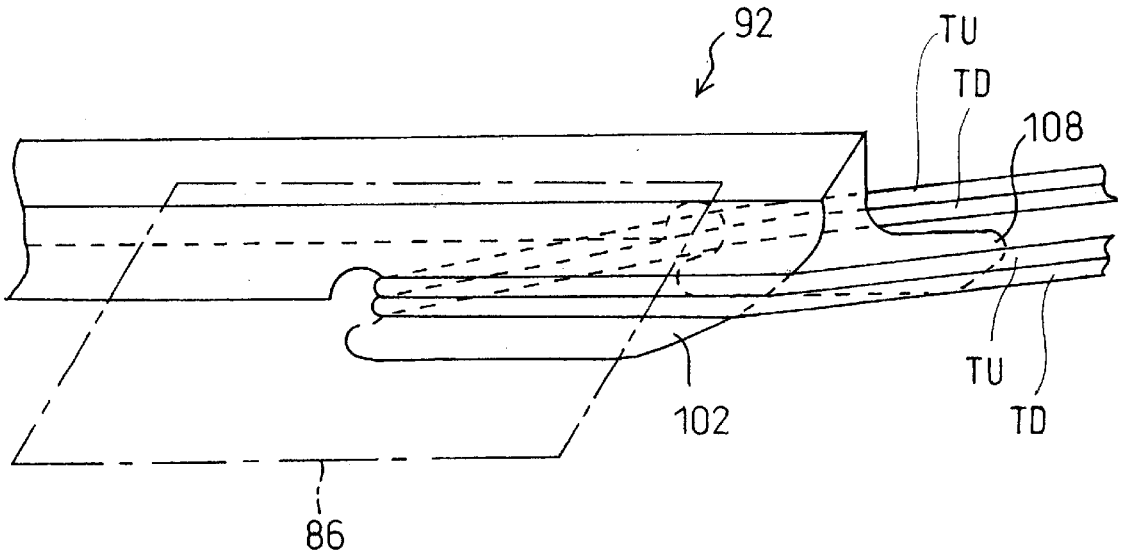
FIG. 39 is an enlarged view of the thread catcher in the state as shown in FIG. 31.
Figure 40:
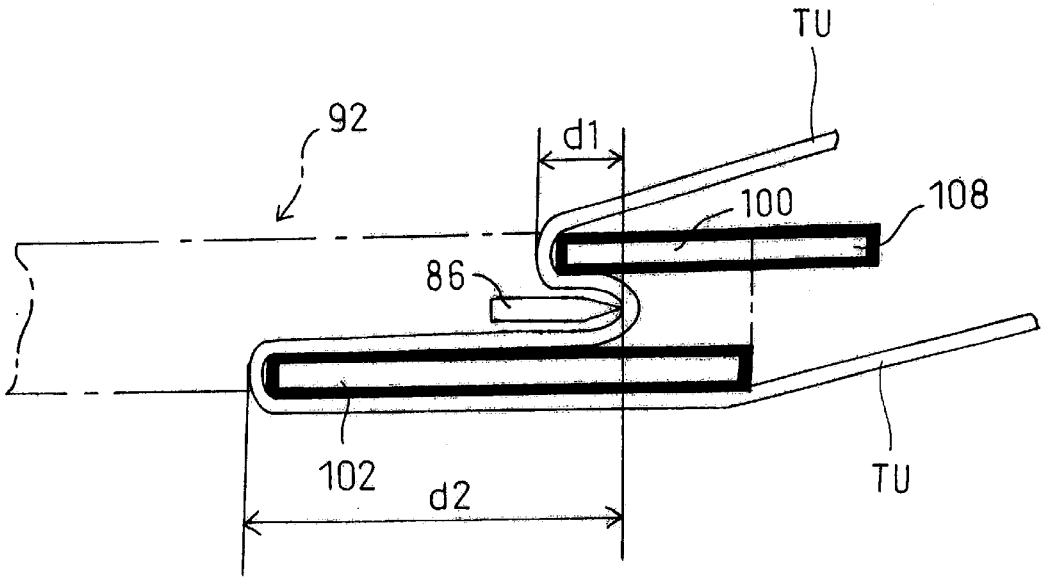
FIG. 40 is a plan view of the thread catcher in the state as shown in FIG. 31.

After restart of the return movement, the middle needle thread TU and bobbin thread TD between the caught portion and the needle hole 29 come into contact with the left side to the front side of the 25*c* with leftward movement of the thread catcher 92. The needle thread TU and bobbin thread TD between the caught portion and the needle hole 29 are bent at the contact portions. More specifically, the needle thread TU and bobbin thread TD between the caught portion and the portion in contact with the 25*c* come nearer than the needle thread TU and bobbin thread TD between the portion in contact with the 25*c* and the needle hole 29 and go to an inner part (right side) of the opening of the hook of the first thread catching portion 100, whereupon the needle thread TU and bobbin thread TD are caught by the second thread catching portion 102 (FIGS. 30 and 38, T6). Accordingly, the first and second thread catching portions 100 and 102 are moved leftward with the needle and bobbin threads TU and TD located therebetween being horizontally extended, as viewed at the left side. The horizontal needle and bobbin threads TU and TD located between the first and second thread catching portions 100 and 102 are brought into contact with the vertical cutting blade 86 so as to cross the blade. The needle and bobbin threads TU and TD are bent between the first and second thread catching portions 100 and 102 into a shape obtained by turning the character V 90 degrees counterclockwise as viewed from above. Near the thread catcher 92, the needle and bobbin threads TU and TD take a shape of character W turned 90 degrees clockwise, as viewed from above (FIGS. 31, 39 and 40). Thus, the needle and bobbin threads TU and TD are strained and cut by the cutting blade 86 (FIG. 32, T7).

In the return movement of the thread catcher 92 by distance L3, the cutting blade 86 is located between the first and second thread catching portions 100 and 102. The first thread catching portion 100 passes a cutting position of the blade 86 leftward after the second thread catching portion 102, and the thread catcher 92 is returned to the standby position again (T8). The cut needle and bobbin threads TU and TD at the needle side (bobbin side) are held by an elastic feather 110. Further, as shown in FIG. 40, the threads are cut while the first thread catching portion 100 is located on the right of the second thread catching portion 102. Accordingly, regarding the length of the thread end cut in the space between the first and second thread catching portions 100 and 102, the length d2 at the needle side is larger than the length d1 at the cloth side. Consequently, one of cut threads at the needle side can be rendered longer and the other cut thread at the cloth side can be rendered shorter. Thus, the lengths of both threads can be rendered desirable simultaneously.

The above-referenced figures including FIG. 24 show the state where the needle N is located leftmost. According to the foregoing control program, however, the needle and bobbin threads TU and TD can reliably be cut no matter where the needle N is located in swing range. In other words, the sewing machine 10 does not necessitate a plurality of control programs according to the positions of the needle N. However, in order that the control program is changed from one to another, the ROM 152 storing one control program needs to be changed to the ROM storing another control program.

The two vertical thread catching portions 100 and 102 are provided in the sewing machine 10 of the foregoing embodiment. However, two thread catching portions which are inclined but horizontal may be provided, instead. Furthermore, two thread catching portions which are inclined in opposite directions may be provided. Although the cutting blade 86 horizontal to the two vertical thread catching portions 100 and 102 is provided in the sewing machine of the foregoing embodiment, the blade may be inclined when the sewing machine has no problem with the reciprocal movement of the thread catcher 92.

The thread catcher 92 having a sufficient rigidity can easily be made and need not be positioned since the two thread catching portions 100 and 102 are connected by the middle portion 104 in the foregoing embodiment. Independent thread catching members may be welded or screwed together. Although each thread catching portions is provided with no blade in the foregoing embodiment, a blade may be provided on a left end of the hook-shaped portion.

The foregoing description and drawings are merely illustrative of the principles of the present invention and are not to be construed in a limiting sense. Various changes and modifications will become apparent to those of ordinary skill in the art. All such changes and modifications are seen to fall within the scope of the present invention as defined by the appended claims.

I claim:

1. A sewing machine comprising:

a needle plate having a needle hole through which a sewing needle is allowed to pass;

a thread catcher reciprocally moved forward and backward below the needle plate and being elongated in a moving direction, the thread catcher having a frontward end with respect to a direction of forward movement of the thread catcher and including first and second generally hook-shaped catching portions, the first catching portion being located nearer to the frontward end of the thread catcher than the second catching portion with respect to the moving direction of the thread catcher during forward movement of the thread catcher, the first catching portion being further spaced from and located nearer to the needle hole of the needle plate than the second catching portion with respect to a direction perpendicular to the moving direction of the thread catcher; and a cutting blade located between the first and second catching portions at least during backward movement of the thread catcher to cut a thread caught between the first and second catching portions, wherein the thread catcher is moved backward so that the thread caught between the first and second catching portions intersects the cutting blade.

2. A sewing machine according to claim 1, wherein the first catching portion passes a cutting location during a backward movement of the thread catcher with a delay in time relative to the second catching portion.

3. A sewing machine according to claim 1, wherein the first and second catching portions are continuous with each other and the thread catcher includes a middle portion extending generally perpendicularly to the first and second catching portions.

4. A sewing machine according to claim 1, wherein the first catching portion has a frontward end with respect to a direction of forward movement of the thread catcher, the frontward end being formed with a stepped portion.

5. A sewing machine according to claim 4, wherein the thread catcher includes a distal end located further frontward relative to the frontward end with respect to the direction of the forward movement of the thread catcher, and the distal end includes at least a part of an underside thereof which is located lower than the hook-shaped portion of the first thread catching portion during the forward movement of the thread catcher.

6. A sewing machine according to claim 1, wherein the first catching portion has a frontward end with respect to a direction of forward movement of the thread catcher, the frontward end being provided with means for preventing a needle thread from falling.

7. A sewing machine according to claim 6, wherein the thread catcher includes a distal end located further frontward relative to the frontward end with respect to the direction of the forward movement of the thread catcher, and the distal end includes at least a part of an underside thereof which is moved while downwardly thrusting the thread to be caught by the first thread catching portion, thereby guiding the thread to the first thread catching portion.

8. A sewing machine comprising:

a needle plate having a needle hole through which a sewing needle is allowed to pass;

a thread catcher reciprocally moved forward and backward below the needle plate and being elongated in a moving direction, the thread catcher having a frontward end with respect to a direction of forward movement of the thread catcher and including first and second generally hook-shaped catching portions, the first catching portion being located nearer to the frontward end of the thread catcher than the second catching portion with respect to the moving direction of the thread catcher during forward movement of the thread catcher, the first catching portion being further spaced from and located nearer to the needle hole of the needle plate than the second catching portion with respect to a direction perpendicular to the moving direction of the thread catcher; and a thread cutting mechanism including a cutting blade located between the first and second catching portions at least during a backward movement of the thread catcher to cut a thread caught between the first and second catching portions, the thread cutting mechanism reciprocally moving the thread catcher forward and backward, the thread cutting mechanism moving the thread catcher backward so that the thread caught between the first and second catching portions intersects the cutting blade and so that the first catching portion passes a cutting location during the backward movement of the thread catcher with a delay in time relative to the second catching portion.

9. A thread cutter for a sewing machine including a sewing needle and a needle plate having a needle hole through which the sewing needle is allowed to pass, the thread cutter comprising:

a thread catcher reciprocally moved forward and backward below the needle plate and being elongated in a moving direction, the thread catcher having a frontward end with respect to a direction of forward movement of the thread catcher and including first and second generally hook-shaped catching portions, the first catching portion being located nearer to the frontward end of the thread catcher than the second catching portion with respect to the moving direction of the thread catcher during forward movement of the thread catcher, the first catching portion being further spaced from and located nearer to the needle hole of the needle plate than the second catching portion with respect to a direction perpendicular to the moving direction of the thread catcher; and a thread cutting mechanism including a cutting blade located between the first and second catching portions at least during a backward movement of the thread catcher to cut a thread caught between the first and second catching portions, the thread cutting mechanism reciprocally moving the thread catcher forward and backward, the thread cutting mechanism moving the thread catcher backward so that the thread caught between the first and second catching portions intersects the cutting blade and so that the first catching portion passes a cutting location during the backward movement of the thread catcher with a delay in time relative to the second catching portion.

* * * * *